US009235151B2

(12) United States Patent
Tanaka et al.

(10) Patent No.: US 9,235,151 B2
(45) Date of Patent: Jan. 12, 2016

(54) MAGNETIC TONER

(71) Applicant: CANON KABUSHIKI KAISHA, Tokyo (JP)

(72) Inventors: Keisuke Tanaka, Yokohama (JP); Michihisa Magome, Mishima (JP); Yusuke Hasegawa, Suntou-gun (JP); Tomohisa Sano, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/364,638

(22) PCT Filed: Jan. 31, 2013

(86) PCT No.: PCT/JP2013/052775

§ 371 (c)(1),
(2) Date: Jun. 11, 2014

(87) PCT Pub. No.: WO2013/115408

PCT Pub. Date: Aug. 8, 2013

(65) Prior Publication Data

US 2014/0322640 A1 Oct. 30, 2014

(30) Foreign Application Priority Data

Feb. 1, 2012 (JP) ..... 2012-019521

(51) Int. Cl.
*G03G 9/083* (2006.01)
*G03G 9/097* (2006.01)

(52) U.S. Cl.
CPC ..... *G03G 9/0838* (2013.01); *G03G 9/083* (2013.01); *G03G 9/0832* (2013.01); *G03G 9/0839* (2013.01); *G03G 9/09708* (2013.01); *G03G 9/09725* (2013.01)

(58) Field of Classification Search
CPC ..... G03G 9/09725; G03G 9/09708; G03G 9/083; G03G 9/0833
USPC ..... 430/106.1, 106.2, 108.7, 108.6
See application file for complete search history.

(56) References Cited

U.S. PATENT DOCUMENTS

| | | | | |
|---|---|---|---|---|
| 6,485,876 | B1 | 11/2002 | Takezawa et al. | |
| 6,677,092 | B2 * | 1/2004 | Arai | 430/106.1 |
| 7,390,604 | B2 | 6/2008 | Miyakawa et al. | |
| 8,232,036 | B2 | 7/2012 | Moriya et al. | |

FOREIGN PATENT DOCUMENTS

| | | | | |
|---|---|---|---|---|
| JP | 2001-117267 | A | | 4/2001 |
| JP | 2001-305780 | A | | 11/2001 |
| JP | 2006-201563 | A | | 8/2006 |
| JP | 3812890 | B2 | | 8/2006 |
| JP | 2007-293043 | A | | 11/2007 |
| JP | 2008-015248 | A | * | 1/2008 |
| JP | 2010-85667 | A | | 4/2010 |
| WO | 2009/031551 | A1 | | 3/2009 |

OTHER PUBLICATIONS

European Patent Office machiine-assisted English-language translation of Japanese Patent Document JP 2008-015248 A (published Jan. 2008).*
Japanese Patent Office (JPO) English-language abstract describing JP 2010-224128 (A) (pub. Oct. 7, 2010), copyright 2011, JPO &INPIT.*
Japanese Patent Office (JPO) English-language abstract describing JP 2010-282017 (A) (pub.Dec. 16, 2010), copyright 2011, JPO &INPIT.*
Taiwanese Office Action dated Dec. 24, 2014 in Taiwanese Application No. 102104010.
Hasegawa, et al., U.S. Appl. No. 14/364,067, filed Jun. 9, 2014.
Magome, et al., U.S. Appl. No. 14/364,068, filed Jun. 9, 2014.
Hiroko, et al., U.S. Appl. No. 14/364,065, filed Jun. 9, 2014.
Suzumura, et al., U.S. Appl. No. 14/362,380, filed Jun. 2, 2014.
Matsui, et al., U.S. Appl. No. 14/362,377, filed Jun. 2, 2014.
Ohmori, et al., U.S. Appl. No. 14/364,633, filed Jun. 11, 2014.
Sano, et al., U.S. Appl. No. 14/364,636, filed Jun. 11, 2014.
Uratani, et al., U.S. Appl. No. 14/364,634, filed Jun. 11, 2014.
Nomura, et al., U.S. Appl. No. 14/364,640, filed Jun. 11, 2014.
Hasegawa, et al., U.S. Appl. No. 14/304,296, filed Jun. 13, 2014.
PCT International Search Report and Written Opinion of the International Searching Authority, International Application No. JP2013/052775, Mailing Date Apr. 16, 2013.

* cited by examiner

*Primary Examiner* — Janis L Dote
(74) *Attorney, Agent, or Firm* — Fitzpatrick, Cella, Harper and Scinto

(57) ABSTRACT

A magnetic toner containing: magnetic toner particles containing a binder resin and a magnetic body; and inorganic fine particles, as described in the specification, present on the surface of the magnetic toner particles. A coverage ratio A of the magnetic toner particles' surface by the inorganic fine particles, as described in the specification, and a coverage ratio B of the magnetic toner particles' surface by the inorganic fine particles each of which is fixed to the magnetic toner particles' surface, as described in the specification, have prescribed values and a prescribed relationship in the magnetic toner. The alumina fine particles and/or titania fine particles are present on the surface of the magnetic toner particles as described in the specification.

3 Claims, 8 Drawing Sheets

MAGNETIC TONER

TECHNICAL FIELD

The present invention relates to a magnetic toner that is used in recording methods that use, for example, electrophotographic methods.

BACKGROUND ART

Numerous methods are known for the execution of electrophotography. At a general level, using a photoconductive material an electrostatic latent image is formed on an electrostatic latent image-bearing member (also referred to as a "photosensitive member" below) by various means. Then, a visible image is made by developing this electrostatic latent image with toner; as necessary the toner image is transferred to a recording medium such as paper; and a copied article is obtained by fixing the toner image on the recording medium by, for example, the application of heat or pressure. For example, copiers and printers are image-forming apparatuses that use such an electrophotographic procedure.

Such copiers and printers are currently being used in quite diverse environments, e.g., low-temperature, low-humidity environments as well as high-temperature, high-humidity environments, and are thus required to output high-quality images without being influenced by the environment. In addition, examples of use outdoors have been increasing quite recently in combination with the downsizing and simplification of image-producing devices, and there is thus also demand for a stable image output regardless of the environment.

The charging state of a toner can be altered by the use environment, and, as one of the image defects produced as a result of this, a phenomenon known as "ghosting" occurs in which density irregularities appear in the image. A brief description of "ghosting" is provided in the following.

Development proceeds through the transfer of toner carried by the toner-carrying member to the electrostatic latent image. During this time, fresh toner is supplied to the regions where the toner on the surface of the toner-carrying member has been consumed (regions corresponding to image areas), while unconsumed toner remains present as such in regions where there has been no toner consumption (regions corresponding to nonimage areas). As a result, a difference in the amount of charging is produced between the freshly supplied toner (hereafter referred to as the supplied toner) and the toner that has remained present (hereafter referred to as the residual toner). Specifically, the freshly supplied toner has a relatively lower amount of charge and the toner that has remained present has a relatively higher amount of charge. Ghosting is produced due to this difference (refer to FIG. 1).

This difference in the amount of charging between the residual toner and the supplied toner is caused by the fact that the number of times the residual toner is subjected to charging grows to large values, in contrast to the fact that the supplied toner is subjected to charging, i.e., is passed through the contact region between the regulating blade and the toner-carrying member (referred to below as the contact region), a single time.

On the other hand, in a low-humidity environment, toner charging is not suppressed since there is little moisture in the air, and a state is assumed in which the charge on the toner is easily ramped up. Due to this, a state ends up being assumed in a low-humidity environment in which the residual toner carries a high amount of charge and the difference in the amount of charge between the supplied toner and residual toner then grows larger and ghosting is further worsened.

To date, the addition of an external additive, e.g., alumina or titania, has been pursued as a method for improving ghosting.

For example, according to Patent Literature 1, alumina is externally added in combination with strontium titanate or hydrophobic silica having a regulated BET specific surface area in order to improve the flowability of the toner and improve its aggregative property.

According to Patent Literature 2, large-diameter alumina fine particles are uniformly and tightly attached to the toner in order to improve the transportability at the toner-carrying member by reducing the amount of release external additive.

While a certain effect is obtained according to each of these patent literatures, these effects are inadequate in a low-humidity environment, which is an environment that facilitates the appearance of ghosting.

On the other hand, in order to solve problems caused by external additives, toners that focus in particular on external additive release have been disclosed (for example, Patent Literatures 3 and 4); however, these again cannot be regarded as adequate with regard to the charging performance of the toner.

Moreover, Patent Literature 5 teaches stabilization of the development·transfer steps by controlling the total coverage ratio of the toner base particles by the external additives, and a certain effect is in fact obtained by controlling the theoretical coverage ratio, provided by calculation, for a certain prescribed toner base particle. However, the actual state of binding by external additives may be substantially different from the value calculated assuming the toner to be a sphere, and such a theoretical coverage ratio does not correlate with the ghosting problem described above and improvement has been necessary.

CITATION LIST

Patent Literature

[PTL 1] WO 2009/031551
[PTL 2] Japanese Patent Application Publication No. 2006-201563
[PTL 3] Japanese Patent Application Publication No. 2001-117267
[PTL 4] Japanese Patent Publication No. 3812890
[PTL 5] Japanese Patent Application Publication No. 2007-293043

SUMMARY OF INVENTION

Technical Problems

The present invention was pursued in view of the problems described above with the prior art and provides a magnetic toner that regardless of the environment can yield an image that has a high image density and that is free of ghosting.

Solution to Problem

That is, the present invention relates to a magnetic toner comprising magnetic toner particles comprising a binder resin and a magnetic body; and inorganic fine particles present on the surface of the magnetic toner particles, wherein;

the inorganic fine particles present on the surface of the magnetic toner particles comprise silica fine particles and at least one of alumina fine particles and titania fine particles, wherein;

when a coverage ratio A (%) is a coverage ratio of the magnetic toner particles' surface by the inorganic fine particles each of which has a particle diameter of from at least 5 nm to not more than 50 nm and a coverage ratio B (%) is a coverage ratio of the magnetic toner particles' surface by the inorganic fine particles each of which has a particle diameter of from at least 5 nm to not more than 50 nm and is fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85, and wherein at least one of the alumina fine particles and the titania fine particles each of which has a particle diameter of from at least 100 nm to not more than 800 nm is present on the surface of magnetic toner particles at from at least 1 particle to not more than 150 particles, as the total number of the alumina fine particles and the titania fine particles, per magnetic toner particle.

Advantageous Effects of Invention

The present invention can provide a magnetic toner that, regardless of the use environment, yields an image that has a high image density and is free of ghosting.

DESCRIPTION OF EMBODIMENTS

Figure 1:
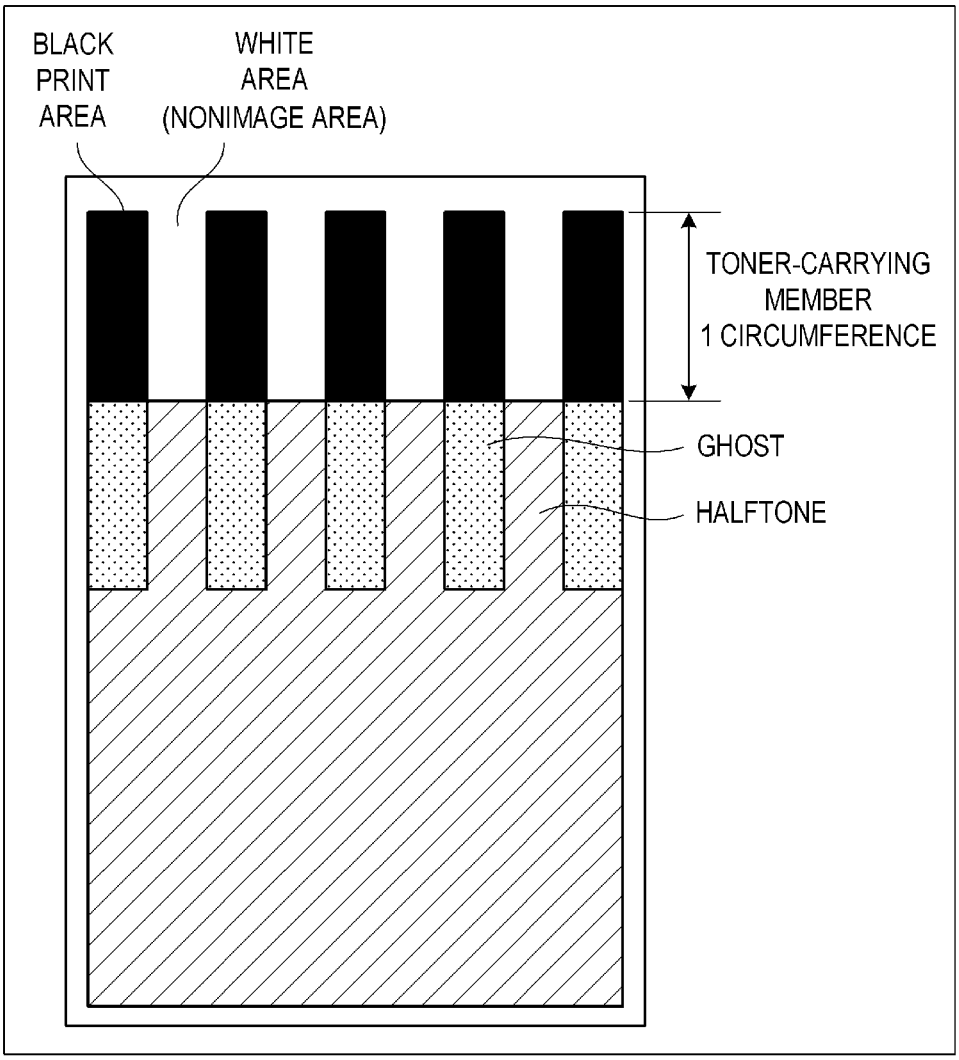
FIG. 1 is a conceptual diagram of ghosting.

The present invention is described in detail below.

The magnetic toner of the present invention (also referred to below simply as toner) is a magnetic toner comprising magnetic toner particles comprising a binder resin and a magnetic body, and inorganic fine particles present on the surface of the magnetic toner particles, wherein, the inorganic fine particles present on the surface of the magnetic toner particles comprise silica fine particles and at least one of alumina fine particles and titania fine particles—that is the inorganic fine particles present on the surface of the magnetic toner particles comprise "silica fine particles and alumina fine particles" or "silica fine particles and titania fine particles" or "silica fine particles, alumina fine particles and titania fine particles"-, wherein, when a coverage ratio A (%) is a coverage ratio of the magnetic toner particles' surface by the inorganic fine particles each of which has a particle diameter of from at least 5 nm to not more than 50 nm and a coverage ratio B (%) is a coverage ratio of the magnetic toner particles' surface by the inorganic fine particles each of which has a particle diameter of from at least 5 nm to not more than 50 nm and is fixed to the magnetic toner particles' surface, the magnetic toner has a coverage ratio A of at least 45.0% and not more than 70.0% and a ratio [coverage ratio B/coverage ratio A] (also referred to below simply as B/A) of the coverage ratio B to the coverage ratio A of at least 0.50 and not more than 0.85, and wherein, at least one of the alumina fine particles and the titania fine particles each of which has a particle diameter of from at least 100 nm to not more than 800 nm is present on the surface of magnetic toner particles at from at least 1 particle to not more than 150 particles, as the total number of the alumina fine particles and the titania fine particles, per magnetic toner particle.

In the following, the inorganic fine particles each of which has a particle diameter of from at least 5 nm to not more than 50 nm is also denoted simply as inorganic fine particles, while the alumina fine particles each of which has a particle diameter of from at least 100 nm to not more than 800 nm and titania fine particles each of which has a particle diameter of from at least 100 nm to not more than 800 nm, are also denoted as large-diameter alumina and large-diameter titania.

As noted above, ghosting is a phenomenon that is caused by the generation of differences between the amount of charge on the supplied toner and the amount of charge on the residual toner. The amount of charge on the supplied toner must be raised in order to abolish the difference in the amount of charge. Since toner charging is produced by contact with the regulating blade, it is crucial to increase the frequency of contact by the toner with the regulating blade.

Figure 2:
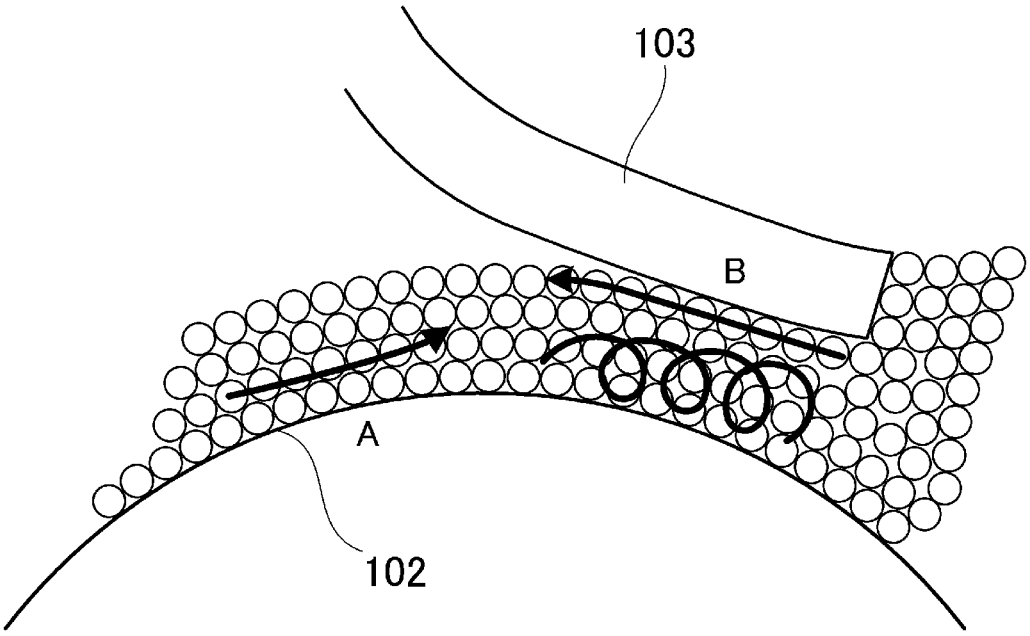
FIG. 2 is a schematic diagram of toner behavior in the contact region between the regulating blade and the toner-carrying member.

A schematic diagram of toner behavior in the contact region between the regulating blade and the toner-carrying member is given in FIG. 2. The toner is transported by the toner-carrying member, and in the contact region a force acts to the toner in the direction of the arrow A due to transport by the toner-carrying member and a force also acts to the toner in the direction B due to a pressing force from the regulating blade. Due to the action of these forces and the influence of unevenness in the surface of the toner-carrying member, the toner undergoes transport while turning over so mixing occurs. Due to turnover by the toner in the contact region, the toner comes into contact with the regulating blade and toner-carrying member and is subjected to rubbing. This results in charging of the toner and the acquisition of electrical charge.

However, in a low-humidity environment, broadening of the charge distribution on the toner readily occurs and a component bearing a charge of the opposite polarity (also referred to below as the inversion component) is readily produced. Electrostatic aggregation is then produced by the electrostatic attraction between this inversion component and the normally charged toner, and turnover of the toner in the contact region as described above thus ends up being impaired. It is for this reason that ghosting is prone to worsen in a low-humidity environment.

Due to this, it can be expected that ghosting can be improved by inhibiting the electrostatic aggregation of the toner and thereby increasing the frequency of contact between the toner and the regulating blade and raising the amount of charge on the toner.

Methods involving the external addition of alumina and/or titania are known as methods for inhibiting this electrostatic aggregation of the toner. However, just the simple external addition of alumina and/or titania by itself has not had a satisfactory effect in environments that support ghosting, such as low-humidity environments.

During focused investigations by the present inventors, ghosting could be substantially improved in a low-humidity environment, which supports the occurrence of ghosting, by having the coverage ratio A be from at least 45.0% to not more than 70.0%, having the ratio [B/A] of the coverage ratio B to the coverage ratio A be from at least 0.50 to not more than 0.85—where the coverage ratio A (%) is the coverage ratio of the magnetic toner particles' surface by the inorganic fine particles each of which has a particle diameter of from at least 5 nm to not more than 50 nm and the coverage ratio B (%) is the coverage ratio of the magnetic toner particles' surface by the inorganic fine particles each of which has a particle diameter of from at least 5 nm to not more than 50 nm and is fixed to the magnetic toner particles' surface—and by regulating the quantity of large-diameter alumina and/or large-diameter titania present on the surface of the magnetic toner particles. The reasons for this are as follows.

That B/A is from at least 0.50 to not more than 0.85 means that inorganic fine particles fixed to the magnetic toner particles' surface are present to a certain degree and that in addition inorganic fine particles are also present in a state that enables their free behavior. B/A is preferably from at least 0.55 to not more than 0.80.

It was found that the inhibitory effect on the electrostatic aggregation of the magnetic toner could be substantially raised when, in addition to bringing the inorganic fine particles into the above-described state of external addition, the presence of large-diameter alumina and/or large-diameter titania on the surface of the magnetic toner particles is also brought about. The reasons for this are thought to be as follows.

In the state of inorganic fine particles external addition according to the present invention, the large-diameter alumina and large-diameter titania can move around freely on the toner, and it is thought that this causes a maximal expression of the inhibitory effect on electrostatic aggregation. The reason why the large-diameter alumina and the large-diameter titania can move around freely on the inorganic fine particles fixed to the magnetic toner particles' surface can be explained as follows.

It is thought that the surface of the magnetic toner particle in which inorganic fine particles are fixed is harder than the surface of the magnetic toner particle in which nothing is fixed. Given such surface states, it is hypothesized that the large-diameter alumina and large-diameter titania can easily roll over the surface of the magnetic toner particle. Accordingly, it is expected that, given the presence of a state of external addition in which inorganic fine particles are fixed, the large-diameter alumina and large-diameter titania can then freely move around the surface of the toner and the inhibitory effect on electrostatic aggregation is thus maximally expressed. In addition, it is thought that the unfixed inorganic fine particles impart flowability to the large-diameter alumina and large-diameter titania. It is hypothesized that this results in a further increase in the ease of movement of the large-diameter alumina and the large-diameter titania and facilitates their rolling and thus increases the inhibitory effect on electrostatic aggregation up to the maximum level.

The van der Waals force is an example of the forces that are produced between a magnetic toner particle and the large-diameter alumina and large-diameter titania. The van der Waals force (F) produced between a flat plate and a particle is represented by the following equation.

$$F=H\times D/(12Z^2)$$

Here, H is Hamaker's constant, D is the diameter of the particle, and Z is the distance between the particle and the flat plate.

With respect to Z, it is generally held that an attractive force operates at large distances and a repulsive force operates at very small distances, and Z is treated as a constant since it is unrelated to the state of the magnetic toner particle surface.

According to the preceding equation, the van der Waals force (F) is proportional to the diameter of the particle in contact with the flat plate. When this is applied to the surface of the large-diameter alumina and large-diameter titania, the van der Waals force (F) is predicted to be smaller for an inorganic fine particle, with its smaller particle diameter, in contact with a flat plate than for the large-diameter alumina or large-diameter titania in contact with a flat plate. That is, it is thought that the van der Waals force operating between the particles is smaller for the case of contact through the intermediary of the inorganic fine particles fixed to the magnetic toner particle than for direct contact by the large-diameter alumina or large-diameter titania with the magnetic toner particle.

Whether the large-diameter alumina or large-diameter titania is in direct contact with the magnetic toner particle or is in contact therewith through the intermediary of the inorganic fine particles, depends on the degree to which the inorganic fine particles cover the surface of the magnetic toner particle, i.e., on the coverage ratio by the inorganic fine particles. Due to this, the coverage ratio of the magnetic toner particle surface by the inorganic fine particles must also be considered. The frequency of direct contact between a magnetic toner particle and the large-diameter alumina and large-diameter titania is reduced at a high coverage ratio by the inorganic fine particles. This also increases the frequency of contact through the intermediary of the inorganic fine particles and increases the number of large-diameter alumina and large-diameter titania particles that can move around almost without being subjected to the van der Waals force. Due to this, it is thought that the large-diameter alumina and/or large-diameter titania can easily move on the magnetic toner particle surface and the inhibitory effect on electrostatic aggregation is then maximally expressed.

When, on the other hand, the coverage ratio by the inorganic fine particles is low, the frequency of direct contact between the large-diameter alumina or large-diameter titania and the magnetic toner particles is then large. As a consequence, the frequency of contact through the intermediary of the inorganic fine particles is also reduced; the van der Waals force then becomes effective; and the number of large-diameter alumina and large-diameter titania particles exhibiting restrained movement is increased. Due to this, it is thought that movement of the large-diameter alumina and/or large-diameter titania on the magnetic toner particle surface is made more difficult and the inhibitory effect on electrostatic aggregation is reduced.

With regard to the coverage ratio of the inorganic fine particles as an external additive, a theoretical coverage ratio can be calculated—on the assumption that the inorganic fine particles and the magnetic toner have a spherical shape— using the equation described, for example, in Patent Literature 5. However, there are also many instances in which the inorganic fine particles and/or the magnetic toner do not have a spherical shape, and in addition the inorganic fine particles may also be present in an aggregated state on the toner particle surface. As a consequence, the theoretical coverage ratio derived using the indicated technique does not pertain to ghosting.

The present inventors therefore carried out observation of the magnetic toner surface with the scanning electron microscope (SEM) and determined the coverage ratio for the actual coverage of the magnetic toner particle surface by the inorganic fine particles.

Figure 3:
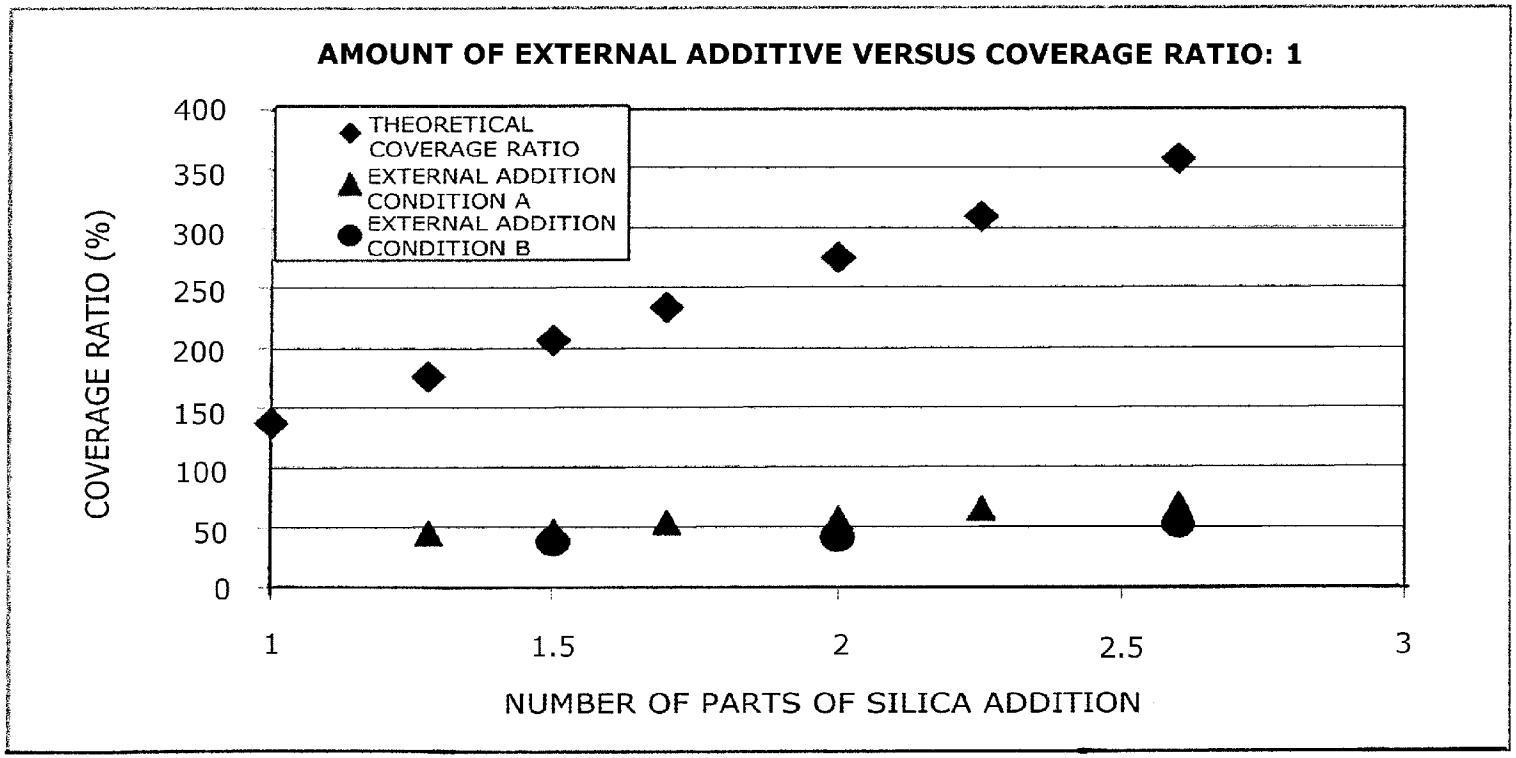
FIG. 3 is a diagram that shows the relationship between the amount of external additive and the external additive coverage ratio.
Figure 4:
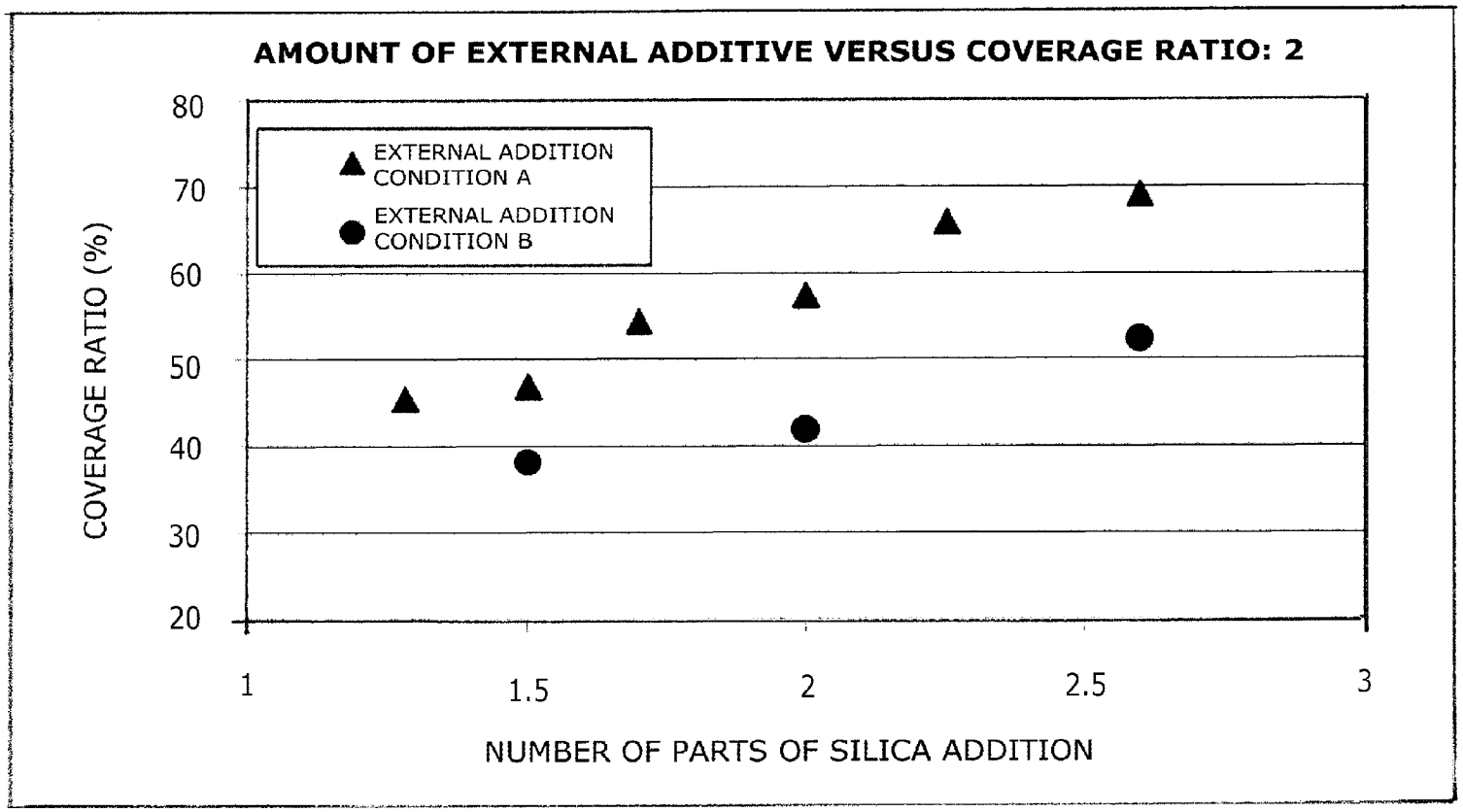
FIG. 4 is a diagram that shows the relationship between the amount of external additive and the external additive coverage ratio.

As one example, the theoretical coverage ratio and the actual coverage ratio were determined for mixtures prepared by adding different amounts of silica fine particles (number of parts of silica addition to 100 mass parts of magnetic toner particles) to the magnetic toner particles (magnetic body content being 43.5 mass %) provided by a pulverization method and having a volume-average particle diameter (Dv) of 8.0 μm (refer to FIGS. 3 and 4). Silica fine particles with a volume-average particle diameter (Dv) of 15 nm were used for the silica fine particles. For the calculation of the theoretical coverage ratio, 2.2 g/cm$^3$ was used for the true specific gravity of the silica fine particles; 1.65 g/cm$^3$ was used for the true specific gravity of the magnetic toner; and monodisperse particles with a particle diameter of 15 nm and 8.0 μm were assumed for, respectively, the silica fine particles and the magnetic toner particles.

As shown in a graph in FIG. 3, the theoretical coverage ratio exceeds 100% as the amount of addition of the silica fine particles is increased. On the other hand, the actual coverage ratio obtained by actual observation does vary with the amount of addition of the silica fine particles, but does not exceed 100%. This is due to silica fine particles being present to some degree as aggregates on the magnetic toner surface or is due to a large effect from the silica fine particles not being spherical.

Moreover, according to investigations by the present inventors, it was found that, even at the same amount of addition by the silica fine particles, the coverage ratio varied with the external addition technique. That is, it is not possible to determine the coverage ratio uniquely from the amount of addition of the inorganic fine particles (refer to FIG. 4). Here, external addition condition A refers to mixing at 1.0 W/g for a processing time of 5 minutes using the apparatus shown in FIG. 5. External addition condition B refers to mixing at 4000 rpm for a processing time of 2 minutes using an FM10C HENSCHEL mixer (from Mitsui Miike Chemical Engineering Machinery Co., Ltd.).

For the reasons provided in the preceding, the present inventors used the inorganic fine particle coverage ratio obtained by SEM observation of the magnetic toner surface.

With regard to the coverage ratio by the inorganic fine particles, it is thought that, as described above, a higher coverage ratio A makes it easier for the large-diameter alumina or large-diameter titania to roll on the magnetic toner particle surface and thereby supports an increase in the inhibitory effect on electrostatic aggregation.

When the coverage ratio A is at least 45.0% and B/A is at least 0.50, it is thought that the large-diameter alumina and large-diameter titania experience an increase in the frequency of contact with the magnetic toner through the intermediary of the inorganic fine particles fixed to the magnetic toner particle surface and then more easily move on the magnetic toner particle surface and the inhibitory effect on electrostatic aggregation is substantially manifested.

When, on the other hand, a coverage ratio A larger than 70.0% is sought, the inorganic fine particles must be added in large amounts, and this is disadvantageous, even if an external addition process could be devised, because image defects, for example, vertical streaks, are then easily produced by the released inorganic fine particles.

In addition, when the coverage ratio A is less than 45.0%, the frequency with which the large-diameter alumina and large-diameter titania come into direct contact with the magnetic toner undergoes an increase and movement on the magnetic toner particle surface is impaired and the inhibitory effect on electrostatic aggregation is weakened. Due to this, mixing in the contact region between the regulating blade and the toner-carrying member is impaired and charge ramp up is slowed and ghosting is not improved. The coverage ratio A is preferably from at least 45.0% to not more than 65.0%.

It is crucial in the present invention that at least one of the alumina fine particles each of which has a particle diameter of from at least 100 nm to not more than 800 nm and the titania fine particles each of which has a particle diameter of from at least 100 nm to not more than 800 nm (i.e., at least one of the large-diameter alumina and the large-diameter titania) be present on the surface of the magnetic toner particles at from at least 1 particle to not more than 150 particles, as the total number of the alumina fine particles and the titania fine particles, per magnetic toner particle.

The reasons that the large-diameter alumina and/or the large-diameter titania inhibits electrostatic aggregation in the above-described state of external addition are thought to be as follows.

First, the large-diameter alumina and the large-diameter titania have a high dielectric constant and due to this are polarized when attached on the magnetic toner surface. When this occurs, the surface of the large-diameter alumina or large-diameter titania on the side not in contact with the magnetic toner particle becomes homopolar with the magnetic toner particle and electrostatic repulsion operates between these homopoles and a repulsive force is produced. An inhibitory effect on electrostatic aggregation is thought to appear as a result. In addition, it is thought that because the large-diameter alumina and large-diameter titania can freely move around on the magnetic toner surface as described above, the inhibitory effect on electrostatic aggregation is raised still further and ghosting is improved.

Second, the number of the large-diameter alumina and/or large-diameter titania particles will now be considered. In the case where at least one of the alumina fine particles each of which has a particle diameter of from at least 100 nm to not more than 800 nm and the titania fine particles each of which has a particle diameter of from at least 100 nm to not more than 800 nm (i.e., at least one of the large-diameter alumina and the large-diameter titania) is present on the surface of the magnetic toner particles at from at least 1 particle to not more than 150 particles, as the total number of the alumina fine particles and the titania fine particles, per magnetic toner particle, due to the homopolarity this increases the opportunity for the generation of repulsion between the polarized large-diameter alumina and large-diameter titania on the magnetic toner surface. An inhibitory effect on electrostatic aggregation by the magnetic toner then operates as a consequence and the ghosting is improved. When the total number of the large-diameter alumina and/or large-diameter titania particles is less than 1 per magnetic toner particle, the inhibitory effect on electrostatic aggregation is weakened due to their scarce presence. When, on the other hand, the total number of the large-diameter alumina and/or large-diameter titania exceeds 150, this is disadvantageous because there is then an increase in the large-diameter particles that undergo release, which facilitates the appearance of image defects, for example, vertical stripes.

Moreover, when the particle diameter for these alumina fine particles or titania fine particles is less than 100 nm, they then easily become fixed to the magnetic toner particle surface and movement of the large-diameter alumina or large-diameter titania on the magnetic toner surface is impaired and the inhibitory effect on electrostatic aggregation is reduced. Conversely, a particle diameter for these alumina fine particles or titania fine particles of larger than 800 nm is disadvantageous because they then exhibit a behavior in which they completely release from the magnetic toner, which facilitates the appearance of image defects.

From at least 1 to not more than 120 is preferred for the number of the large-diameter alumina and/or large-diameter titania particles.

On the other hand, the number of the large-diameter alumina and/or large-diameter titania particles can be adjusted into the range indicated above by controlling the particle diameter of the large-diameter alumina and/or large-diameter titania, the amount of addition, and the external addition conditions.

The coefficient of variation on the coverage ratio A is preferably not more than 10.0% in the present invention. Not more than 8.0% is more preferred. As has been described up to this point, it is thought that the coverage ratio A correlates with the mobility of the large-diameter alumina and/or large-diameter titania on the magnetic toner particle surface. The specification of a coefficient of variation on the coverage ratio A of not more than 10.0% means that the coverage ratio A is uniform between magnetic toner particles and within magnetic toner particles. When the coverage ratio A is uniform, there is no unevenness with regard to the region on the magnetic toner particle surface in which the large-diameter alumina and large-diameter titania can easily move, and due to this the inhibitory effect on electrostatic aggregation is raised and an additional improvement in ghosting is obtained.

There are no particular limitations on the technique for bringing the coefficient of variation on the coverage ratio A to 10.0% or below, but the use is preferred of the external addition apparatus and technique described below, which are capable of bringing about a high degree of spreading of the inorganic fine particles each of which has a particle diameter of from at least 5 nm to not more than 50 nm over the magnetic toner particles' surface.

The amount of the at least one of the alumina fine particles and the titania fine particles each of which has a particle diameter of from at least 100 nm to not more than 800 nm and is present on the surface of the magnetic toner particles preferably satisfies the following formula (1) in the present invention. The following formula (2) is more preferably satisfied.

$$(X-Y)/X \geq 0.75 \quad \text{formula (1)}$$

$$(X-Y)/X \geq 0.90 \quad \text{formula (2)}$$

In formulas (1) and (2), X is the total number of the at least one of the alumina fine particles each of which has a particle diameter of from at least 100 nm to not more than 800 nm and is present on the surface of the magnetic toner particles and the titania fine particles each of which has a particle diameter of from at least 100 nm to not more than 800 nm and is present on the surface of the magnetic toner particles, per magnetic toner particle.

Y is the total number of the at least one of the alumina fine particles each of which has a particle diameter of from at least 100 nm to not more than 800 nm and is fixed to the magnetic toner particles' surface and the titania fine particles each of which has a particle diameter of from at least 100 nm to not more than 800 nm and is fixed to the magnetic toner particles' surface, per magnetic toner particle.

The specification of $(X-Y)/X \geq 0.75$ indicates that at least 75% of the large-diameter alumina and/or large-diameter titania is present on the magnetic toner particles' surface in an attached state on the magnetic toner particle without being fixed to the magnetic toner particle. When this state is present, there is a large number of large-diameter alumina or large-diameter titania particles capable of free behavior on the magnetic toner particles' surface and the inhibitory effect on electrostatic aggregation is raised and an additional improvement in ghosting is obtained.

This $(X-Y)/X$ can be adjusted into the above-indicated range by carrying out external addition by adding the inorganic fine particles at the same time as the large-diameter alumina and/or the large-diameter titania in the external addition step. Adjustment into the vicinity of the lower limit value for the above-indicated range can be carried out by dividing the external addition step into at least two stages and externally adding the large-diameter alumina or large-diameter titania in the first stage.

The binder resin in the magnetic toner in the present invention can be exemplified by vinyl resins, polyester resins, and so forth, but is not particularly limited and the heretofore known resins can be used.

Specifically, polystyrene or a styrene copolymer, e.g., a styrene-propylene copolymer, styrene-vinyltoluene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-octyl methacrylate copolymer, styrene-butadiene copolymer, styrene-isoprene copolymer, styrene-maleic acid copolymer, or styrene-maleate copolymer; as well as a polyacrylate ester; polymethacrylate ester; polyvinyl acetate; and so forth, can be used, and a single one of these may be used or a combination of a plurality of these may be used. Styrene copolymers and polyester resins are preferred among the preceding from the standpoint of, e.g., the developing characteristics and the fixing performance.

The glass-transition temperature (Tg) of the magnetic toner of the present invention is preferably from at least 40° C. to not more than 70° C. When the glass-transition temperature of the magnetic toner is from at least 40° C. to not more than 70° C., preferable results are obtained in which the storage stability and durability are enhanced while maintaining a favorable fixing performance.

A charge control agent is preferably added to the magnetic toner of the present invention. Moreover, a negative-charging toner is preferred for the present invention.

Organometal complex compounds and chelate compounds are effective as charging agents for negative charging and can be exemplified by monoazo-metal complex compounds; acetylacetone-metal complex compounds; and metal complex compounds of aromatic hydroxycarboxylic acids and aromatic dicarboxylic acids. Specific examples of commercially available products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used or two or more may be used in combination. Considered from the standpoint of the amount of charging of the magnetic toner, these charge control agents are used, expressed per 100 mass parts of the binder resin, preferably at from 0.1 to 10.0 mass parts and more preferably at from 0.1 to 5.0 mass parts.

The magnetic toner of the present invention may as necessary also incorporate a release agent in order to improve the fixing performance. Any known release agent can be used for this release agent. Specific examples are petroleum waxes, e.g., paraffin wax, microcrystalline wax, and petrolatum, and their derivatives; montan waxes and their derivatives; hydrocarbon waxes provided by the Fischer-Tropsch method and their derivatives; polyolefin waxes, as typified by polyethylene and polypropylene, and their derivatives; natural waxes, e.g., carnauba wax and candelilla wax, and their derivatives; and ester waxes. Here, the derivatives include oxidized products, block copolymers with vinyl monomers, and graft modifications. In addition, the ester wax can be a monofunctional ester wax or a multifunctional ester wax, e.g., most prominently a difunctional ester wax but also a tetrafunctional or hexafunctional ester wax.

When a release agent is used in the magnetic toner of the present invention, its content is preferably from at least 0.5 mass parts to not more than 10 mass parts per 100 mass parts of the binder resin. When the release agent content is in the indicated range, the fixing performance is enhanced while the storage stability of the magnetic toner is not impaired.

The release agent can be incorporated in the binder resin by, for example, a method in which, during resin production, the resin is dissolved in a solvent, the temperature of the resin solution is raised, and addition and mixing are carried out while stirring, or a method in which addition is carried out during melt kneading during production of the magnetic toner.

The peak temperature (also referred to below as the melting point) of the maximum endothermic peak measured on the release agent using a differential scanning calorimeter (DSC) is preferably from at least 60° C. to not more than 140° C. and more preferably is from at least 70° C. to not more than 130° C. When the peak temperature (melting point) of the maximum endothermic peak is from at least 60° C. to not more than 140° C., the magnetic toner is easily plasticized during fixing and the fixing performance is enhanced. This is also preferred because it works against the appearance of exudation by the release agent even during long-term storage.

The peak temperature of the maximum endothermic peak of the release agent is measured in the present invention based on ASTM D3418-82 using a "Q1000" differential scanning calorimeter (TA Instruments, Inc.). Temperature correction in the instrument detection section is carried out using the melting points of indium and zinc, while the heat of fusion of indium is used to correct the amount of heat.

Specifically, approximately 10 mg of the measurement sample is precisely weighed out and this is introduced into an aluminum pan. Using an empty aluminum pan as the reference, the measurement is performed at a rate of temperature rise of 10° C./min in the measurement temperature range from 30 to 200° C. For the measurement, the temperature is raised to 200° C. and is then dropped to 30° C. and is thereafter raised again at 10° C./min. The peak temperature of the maximum endothermic peak is determined for the release agent from the DSC curve in the temperature range of 30 to 200° C. for this second temperature ramp-up step.

The magnetic body present in the magnetic toner in the present invention can be exemplified by iron oxides such as magnetite, maghemite, ferrite, and so forth; metals such as iron, cobalt, and nickel; and alloys and mixtures of these metals with metals such as aluminum, copper, magnesium, tin, zinc, beryllium, calcium, manganese, selenium, titanium, tungsten, and vanadium.

The number-average particle diameter (D1) of the primary particles of the magnetic bodies is preferably not more than 0.50 μm and more preferably is from 0.05 μm to 0.30 μm.

With regard to the magnetic characteristics for the magnetic field application of 795.8 kA/m of the magnetic body, the coercive force (Hc) is preferably from 1.6 to 12.0 kA/m; a intensity of magnetization (σs) is preferably from 50 to 200 $Am^2/kg$ and more preferably is from 50 to 100 $Am^2/kg$; and the residual magnetization (σr) is preferably from 2 to 20 $Am^2/kg$.

The magnetic toner of the present invention preferably contains from at least 35 mass % to not more than 50 mass % of the magnetic body and more preferably contains from at least 40 mass % to not more than 50 mass %.

When the content of the magnetic body in the magnetic toner is less than 35 mass %, the magnetic attraction to the magnet roller within the developing sleeve is diminished and fogging readily occurs. When, on the other hand, the magnetic body content exceeds 50 mass %, the density may be reduced due to a diminished developing performance.

The content of the magnetic body in the magnetic toner can be measured using a Q5000IR TGA thermal analyzer from PerkinElmer Inc. With regard to the measurement method, the magnetic toner is heated from normal temperature to 900° C. under a nitrogen atmosphere at a rate of temperature rise of 25° C./minute: the mass loss from 100 to 750° C. is taken to be the component provided by subtracting the magnetic body from the magnetic toner and the residual mass is taken to be the amount of the magnetic body.

The magnetic toner of the present invention contains inorganic fine particles at the magnetic toner particles' surface.

The inorganic fine particles present on the magnetic toner particles' surface can be exemplified by silica fine particles, titania fine particles, and alumina fine particles, and these inorganic fine particles can also be favorably used after the execution of a hydrophobic treatment on the surface thereof.

Inorganic fine particles with a primary particle number-average particle diameter (D1) of from at least 5 nm to not more than 50 nm are preferably used in the present invention for the inorganic fine particles that pertain to the coverage ratio A, the coverage ratio B, and B/A. From at least 10 nm to not more than 35 nm is more preferred.

Bringing the number-average particle diameter (D1) of the primary particles in the small diameter inorganic fine particles into the indicated range facilitates favorable control of the coverage ratio A and B/A. When the primary particle number-average particle diameter (D1) is less than 5 nm, the inorganic fine particles tend to aggregate with one another and obtaining a large value for B/A becomes problematic and the coefficient of variation on the coverage ratio A is also prone to assume large values. When, on the other hand, the primary particle number-average particle diameter (D1) of the small diameter inorganic fine particles exceeds 50 nm, the coverage ratio A is prone to be small even at large amounts of addition of the inorganic fine particles; in addition, B/A will also tend to have a low value because it becomes difficult for the inorganic fine particles to become fixed to the magnetic toner particles. That is, it is difficult to obtain the above-described attachment force-reducing effect and bearing effect when the primary particle number-average particle diameter (D1) is greater than 50 nm.

The inorganic fine particles used in the present invention that have a primary particle number-average particle diameter (D1) of from at least 5 nm to not more than 50 nm and the alumina fine particles and/or titania fine particles used in the present invention that have a primary particle number-average particle diameter (D1) of from at least 100 nm to not more than 800 nm (collectively referred to below as inorganic fine particles) are preferably inorganic fine particles on which a hydrophobic treatment has been executed, and particularly preferred inorganic fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these can be used or a mixture of two or more can be used.

The silicone oil can be exemplified by dimethylsilicone oil, methylphenylsilicone oil, a-methylstyrene-modified silicone oil, chlorophenyl silicone oil, and fluorine-modified silicone oil.

A $C_{10-22}$ fatty acid is suitably used for the long-chain fatty acid, and the long-chain fatty acid may be a straight-chain fatty acid or a branched fatty acid. A saturated fatty acid or an unsaturated fatty acid may be used.

Among the preceding, $C_{10-22}$ straight-chain saturated fatty acids are highly preferred because they readily provide a uniform treatment of the surface of the inorganic fine particles.

These straight-chain saturated fatty acids can be exemplified by capric acid, lauric acid, myristic acid, palmitic acid, stearic acid, arachidic acid, and behenic acid.

Inorganic fine particles that have been treated with silicone oil are preferred for the aforementioned inorganic fine particles, and inorganic fine particles treated with an organosilicon compound and a silicone oil are more preferred because this makes possible a favorable control of the hydrophobicity.

The method for treating the inorganic fine particles with a silicone oil can be exemplified by a method in which the silicone oil is directly mixed, using a mixer such as a HENSCHEL mixer, with inorganic fine particles that have been treated with an organosilicon compound, and by a method in which the silicone oil is sprayed on the inorganic fine particles. Another example is a method in which the silicone oil is dissolved or dispersed in a suitable solvent; the inorganic fine particles are then added and mixed; and the solvent is removed.

In order to obtain a good hydrophobicity, the amount of silicone oil used for the treatment, expressed per 100 mass parts of the inorganic fine particles, is preferably from at least 1 mass part to not more than 40 mass parts and is more preferably from at least 3 mass parts to not more than 35 mass parts.

In order to impart an excellent flowability to the magnetic toner, the silica fine particles, titania fine particles, and alumina fine particles, which have the primary particle number-average particle diameter of not less than 5 nm and not more than 50 nm and are used by the present invention, have a specific surface area as measured by the BET method based on nitrogen adsorption (BET specific surface area) preferably of from at least 20 $m^2/g$ to not more than 350 $m^2/g$ and more preferably of from at least 25 $m^2/g$ to not more than 300 $m^2/g$.

On the other hand, in order to provide the magnetic toner with an excellent inhibitory effect on electrostatic aggregation, the alumina fine particles and titania fine particles used in the present invention that have a primary particle number-average particle diameter of from at least 100 nm to not more than 800 nm preferably have a specific surface area measured by the BET method based on nitrogen adsorption (the BET specific surface area) of from at least 3 $m^2/g$ to not more than 15 $m^2/g$ and more preferably from at least 4 $m^2/g$ to not more than 9 $m^2/g$.

Measurement of the specific surface area (BET specific surface area) by the BET method based on nitrogen adsorption is performed based on JIS 28830 (2001). A "TriStar300 (Shimadzu Corporation) automatic specific surface area·pore distribution analyzer", which uses gas adsorption by a constant volume technique as its measurement procedure, is used as the measurement instrument.

In the present invention, the amount of addition of the inorganic fine particles having a primary particle number-average particle diameter of from at least 5 nm to not more than 50 nm and pertaining to the coverage ratio A, the coverage ratio B, and B/A, expressed per 100 mass parts of the magnetic toner particles, is preferably from at least 1.5 mass parts to not more than 3.0 mass parts, more preferably from at least 1.5 mass parts to not more than 2.6 mass parts, and even more preferably from at least 1.8 mass parts to not more than 2.6 mass parts.

On the other hand, the amount of addition of the alumina fine particles and titania fine particles having a primary particle number-average particle diameter of from at least 100 nm to not more than 800 nm, expressed per 100 mass parts of the magnetic toner particles, is preferably from at least 0.01 mass parts to not more than 20 mass parts, more preferably from at least 0.01 mass parts to not more than 18 mass parts, and even more preferably from at least 0.01 mass parts to not more than 15 mass parts.

The number of alumina fine particles and titania fine particles each of which has a particle diameter of from at least 100 nm to not more than 800 nm per magnetic toner particle can be adjusted by adjusting the number of mass parts of addition and the primary particle number-average particle diameter.

The use of the aforementioned range for the amount of addition of the inorganic fine particles having a primary particle number-average particle diameter of from at least 5 nm to not more than 50 nm and pertaining to the coverage ratio A, the coverage ratio B, and B/A facilitates favorable control of the coverage ratio A and B/A and is also preferred from the standpoints of the image density and fogging.

On the other hand, a favorable manifestation of the inhibitory effect on electrostatic aggregation is brought about by using the aforementioned range for the amount of addition of the alumina fine particles and titania fine particles that have a primary particle number-average particle diameter of from at least 100 nm to not more than 800 nm.

The alumina fine particles and titania fine particles that have a primary particle number-average particle diameter of from at least 100 nm to not more than 800 nm are not particularly limited in the present invention with regard to their composition, and a composite composition of two types may be used. With regard to their method of production, they can be produced by a heretofore known technology, for example, gas-phase decomposition, combustion, deflagration, and so forth.

Other additives may also be used in small amounts in the magnetic toner of the present invention to a degree that does not influence the effects of the present invention, for example, a lubricant powder, e.g., a fluororesin powder, zinc stearate powder, or polyvinylidene fluoride powder; a polish, e.g., a cerium oxide powder, a silicon carbide powder, or a strontium titanate powder; an anticaking agent; or developing performance improving agents, e.g., a reverse-polarity organic fine powder or inorganic fine powder. These additives may also be used after a hydrophobic treatment has been executed on the surface thereof.

<Quantitation Methods for the Inorganic Fine Particles>

(1) Determination of the Content of Silica Fine Particles in the Magnetic Toner (Standard Addition Method)

3 g of the magnetic toner is introduced into an aluminum ring having a diameter of 30 mm and a pellet is prepared using a pressure of 10 tons. The silicon (Si) intensity is determined (Si intensity-1) by wavelength-dispersive x-ray fluorescence analysis (XRF). The measurement conditions are preferably optimized for the XRF instrument used and all of the intensity measurements in a series are performed using the same conditions. Silica fine particles with a primary particle number-average particle diameter of 12 nm are added to the magnetic toner at 1.0 mass % with reference to the magnetic toner and mixing is carried out with a coffee mill.

For the silica fine particles admixed at this time, silica fine particles with a primary particle number-average particle diameter of from at least 5 nm to not more than 50 nm can be used without affecting this determination.

After mixing, pellet fabrication is carried out as described above and the Si intensity (Si intensity-2) is determined also as described above. Using the same procedure, the Si intensity (Si intensity-3, Si intensity-4) is also determined for samples prepared by adding and mixing the silica fine particles at 2.0 mass % and 3.0 mass % of the silica fine particles with reference to the magnetic toner. The silica content (mass %) in the magnetic toner based on the standard addition method is calculated using Si intensities-1 to -4.

The titania content (mass %) in the magnetic toner and the alumina content (mass %) in the magnetic toner are determined using the standard addition method and the same procedure as described above for the determination of the silica content. That is, for the titania content (mass %), titania fine particles with a primary particle number-average particle diameter of from at least 5 nm to not more than 50 nm are added and mixed and the determination can be made by determining the titanium (Ti) intensity. For the alumina content (mass %), alumina fine particles with a primary particle number-average particle diameter of from at least 5 nm to not more than 50 nm are added and mixed and the determination can be made by determining the aluminum (Al) intensity.

(2) Separation of the Inorganic Fine Particles from the Magnetic Toner 5 g of the magnetic toner is weighed using a precision balance into a lidded 200-mL plastic cup; 100 mL methanol is added; and dispersion is carried out for 5 minutes using an ultrasound disperser. The magnetic toner is held using a neodymium magnet and the supernatant is discarded. The process of dispersing with methanol and discarding the supernatant is carried out three times, followed by the addition of 100 mL of 10% NaOH and several drops of "Contaminon N" (a 10 mass % aqueous solution of a neutral pH 7 detergent for cleaning precision measurement instrumentation and comprising a nonionic surfactant, an anionic surfactant, and an organic builder, from Wako Pure Chemical Industries, Ltd.), light mixing, and then standing at quiescence for 24 hours. This is followed by re-separation using a neodymium magnet. Repeated washing with distilled water is carried out at this point until NaOH does not remain. The recovered particles are thoroughly dried using a vacuum drier to obtain particles A. The externally added silica fine particles are dissolved and removed by this process. Titania fine particles and alumina fine particles can remain present in particles A since they are sparingly soluble in 10% NaOH.

(3) Measurement of the Si Intensity in the Particles A 3 g of the particles A are introduced into an aluminum ring with a diameter of 30 mm; a pellet is fabricated using a pressure of 10 tons; and the Si intensity (Si intensity-5) is determined by wavelength-dispersive XRF. The silica content (mass %) in particles A is calculated using the Si intensity-5 and the Si intensities-1 to −4 used in the determination of the silica content in the magnetic toner.

(4) Separation of the Magnetic Body from the Magnetic Toner 100 mL of tetrahydrofuran is added to 5 g of the particles A with thorough mixing followed by ultrasound dispersion for 10 minutes. The magnetic body is held with a magnet and the supernatant is discarded. This process is performed 5 times to obtain particles B. This process can almost completely remove the organic component, e.g., resins, outside the magnetic body. However, because a tetrahydrofuran-insoluble matter in the resin can remain, the particles B provided by this process are preferably heated to 800° C. in order to burn off the residual organic component, and the particles C obtained after heating are approximately the magnetic body that was present in the magnetic toner.

Measurement of the mass of the particles C yields the magnetic body content W (mass %) in the magnetic toner. In order to correct for the increment due to oxidation of the magnetic body, the mass of particles C is multiplied by 0.9666 ($Fe_2O_3 \rightarrow Fe_3O_4$).

(5) Measurement of the Ti Intensity and Al Intensity in the Separated Magnetic Body Ti and Al may be present as impurities or additives in the magnetic body. The amount of Ti and Al attributable to the magnetic body can be detected by FP quantitation in wavelength-dispersive XRF. The detected amounts of Ti and Al are converted to titania and alumina and the titania content and alumina content in the magnetic body are then calculated.

The amount of externally added silica fine particles, the amount of externally added titania fine particles, and the amount of externally added alumina fine particles are calculated by substituting the quantitative values obtained by the preceding procedures into the following formulas.

amount of externally added silica fine particles (mass %)=silica content (mass %) in the magnetic toner−silica content (mass %) in particle *A* amount of externally added titania fine particles (mass %)=titania content (mass %) in the magnetic toner−{titania content (mass %) in the magnetic body×magnetic body content *W*/100} amount of externally added alumina fine particles (mass %)=alumina content (mass %) in the magnetic toner−{alumina content (mass %) in the magnetic body×magnetic body content *W*/100}

Examples of methods for producing the magnetic toner of the present invention are provided below, but there is no intent to limit the production method to these. The magnetic toner of the present invention can be produced by any known method of production that has a step or steps that make possible adjustment of the coverage ratio A, B/A, and the amount of the large-diameter alumina or large-diameter titania present on the magnetic toner particle surface, while the other production steps are not particularly limited.

The following method is a favorable example of such a production method. First, the binder resin and magnetic body and as necessary other raw materials, e.g., a release agent and a charge control agent, are thoroughly mixed using a mixer such as a HENSCHEL mixer or ball mill and are then melted, worked, and kneaded using a heated kneading apparatus such as a roll, kneader, or extruder to compatibilize the resins with each other.

The obtained melted and kneaded material is cooled and solidified and then coarsely pulverized, finely pulverized, and classified, and the external additives, e.g., inorganic fine particles, are externally added and mixed into the resulting magnetic toner particles to obtain the magnetic toner.

The mixer used here can be exemplified by the HENSCHEL mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation).

The aforementioned kneading apparatus can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The aforementioned pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average circularity can be controlled by adjusting the exhaust gas temperature during micropulverization using a Turbo Mill. A lower exhaust gas temperature (for example, no more than 40° C.) provides a lower value for the average circularity while a higher exhaust gas temperature (for example, around 50° C.) provides a higher value for the average circularity.

The aforementioned classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

Figure 5:
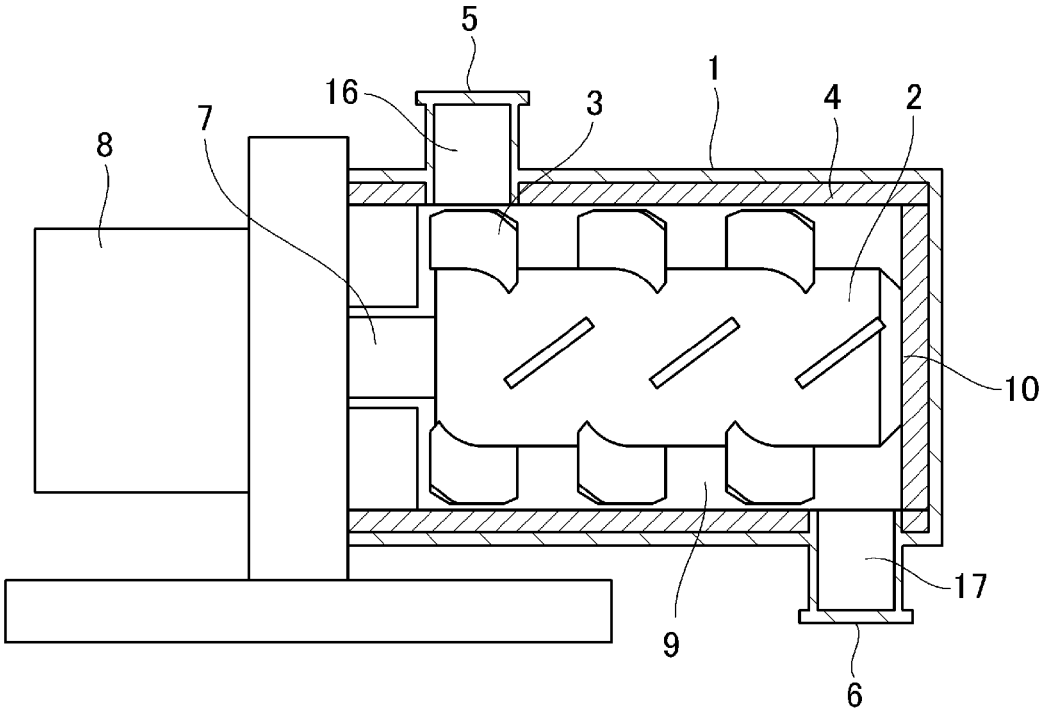
FIG. 5 is a schematic diagram that shows an example of a mixing process apparatus that can be used for the external addition and mixing of inorganic fine particles.

A known mixing process apparatus, e.g., the mixers described above, can be used as the mixing process apparatus for the external addition and mixing of the inorganic fine particles; however, an apparatus as shown in FIG. 5 is preferred from the standpoint of enabling facile control of the coverage ratio A, B/A, and the coefficient of variation on the coverage ratio A.

FIG. 5 is a schematic diagram that shows an example of a mixing process apparatus that can be used to carry out the external addition and mixing of the inorganic fine particles used by the present invention.

This mixing process apparatus readily brings about fixing of the inorganic fine particles to the magnetic toner particle surface because it has a structure that applies shear in a narrow clearance region to the magnetic toner particles and the inorganic fine particles.

Furthermore, as described below, the coverage ratio A, B/A, and the coefficient of variation on the coverage ratio A are easily controlled into the ranges preferred for the present invention because circulation of the magnetic toner particles and inorganic fine particles in the axial direction of the rotating member is facilitated and because a thorough and uniform mixing is facilitated prior to the development of fixing.

Figure 6:
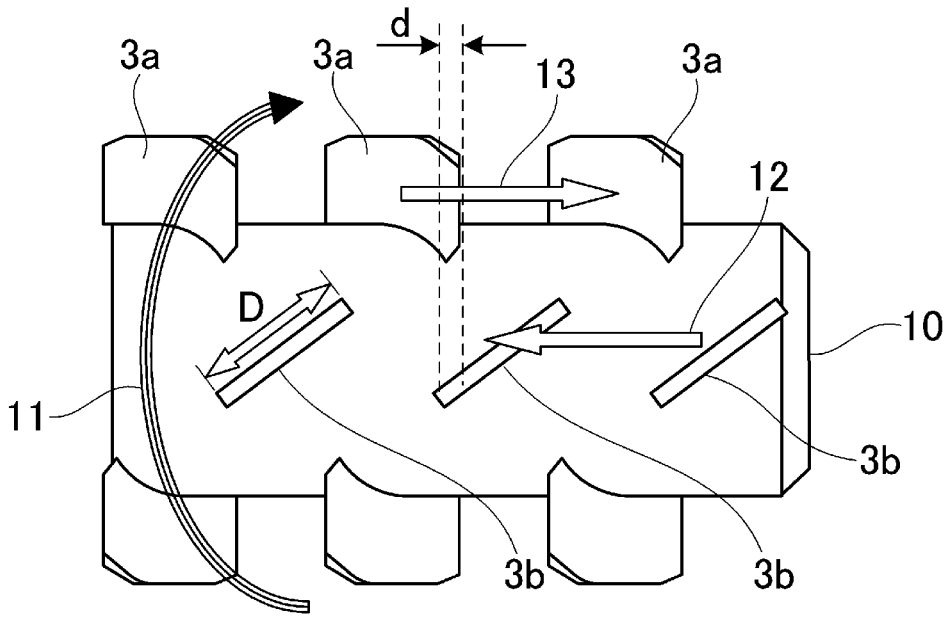
FIG. 6 is a schematic diagram that shows an example of the structure of a stirring member used in the mixing process apparatus.

On the other hand, FIG. 6 is a schematic diagram that shows an example of the structure of the stirring member used in the aforementioned mixing process apparatus.

The external addition and mixing process for the inorganic fine particles is described below using FIGS. 5 and 6.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

It is important that the gap (clearance) between the inner circumference of the main casing 1 and the stirring member 3 be maintained constant and very small in order to apply a uniform shear to the magnetic toner particles and facilitate the fixing of the inorganic fine particles to the magnetic toner particle surface.

The diameter of the inner circumference of the main casing 1 in this apparatus is not more than twice the diameter of the outer circumference of the rotating member 2. In FIG. 5, an example is shown in which the diameter of the inner circumference of the main casing 1 is 1.7-times the diameter of the outer circumference of the rotating member 2 (the trunk diameter provided by subtracting the stirring member 3 from the rotating member 2). When the diameter of the inner circumference of the main casing 1 is not more than twice the diameter of the outer circumference of the rotating member 2, impact force is satisfactorily applied to the magnetic toner particles since the processing space in which forces act on the magnetic toner particles is suitably limited.

In addition, it is important that the aforementioned clearance be adjusted in conformity to the size of the main casing. Viewed from the standpoint of the application of adequate shear to the magnetic toner particles, it is important that the clearance be made from about at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 6, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when the raw material inlet port 5 and the product discharge port 6 are disposed at the two ends of the main casing 1, as in FIG. 5, the direction toward the product discharge port 6 from the raw material inlet port 5 (the direction to the right in FIG. 5) is the "forward direction".

That is, as shown in FIG. 6, the face of the forward transport stirring member 3*a* is tilted so as to transport the magnetic toner particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the surface of the magnetic toner particles and mixing are carried out while repeatedly performing transport in the "forward direction" (13) and transport in the "back direction" (12).

In addition, with regard to the stirring members 3*a*, 3*b*, a plurality of members disposed at intervals in the circumferential direction of the rotating member 2 form a set. In the example shown in FIG. 6, two members at an interval of 180° with each other form a set of the stirring members 3*a*, 3*b* on the rotating member 2, but a larger number of members may form a set, such as three at an interval of 120° or four at an interval of 90°.

In the example shown in FIG. 6, a total of twelve stirring members 3*a*, 3*b* are formed at an equal interval.

Furthermore, D in FIG. 6 indicates the width of a stirring member and d indicates the distance that represents the overlapping portion of a stirring member. In FIG. 6, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 6 shows an example in which D is 23%. Furthermore, with regard to the stirring members 3*a* and 3*b*, when an extension line is drawn in the perpendicular direction from the location of the end of the stirring member 3*a*, a certain overlapping portion d of the stirring member with the stirring member 3*b* is preferably present. This serves to efficiently apply shear to the magnetic toner particles. This d is preferably from at least 10% to not more than 30% of D from the standpoint of the application of shear.

In addition to the shape shown in FIG. 6, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 5 and 6.

The apparatus shown in FIG. 5 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

In addition, the apparatus shown in FIG. 5 has a raw material inlet port 5, which is formed on the upper side of the main casing 1 for the purpose of introducing the magnetic toner particles and the inorganic fine particles, and a product discharge port 6, which is formed on the lower side of the main casing 1 for the purpose of discharging, from the main casing to the outside, the magnetic toner that has been subjected to the external addition and mixing process.

The apparatus shown in FIG. 5 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a HENSCHEL mixer and the mixture may thereafter be introduced through the raw material inlet port 5 of the apparatus shown in FIG. 5.

More specifically, with regard to the conditions for the external addition and mixing process, controlling the power of the drive member 8 to from at least 0.2 W/g to not more than 2.0 W/g is preferred in terms of obtaining the coverage ratio A, B/A, and coefficient of variation on the coverage ratio A specified by the present invention. Controlling the power of the drive member 8 to from at least 0.6 W/g to not more than 1.6 W/g is more preferred.

When the power is lower than 0.2 W/g, it is difficult to obtain a high coverage ratio A, and B/A tends to be too low. On the other hand, B/A tends to be too high when 2.0 W/g is exceeded.

The processing time is not particularly limited, but is preferably from at least 3 minutes to not more than 10 minutes. When the processing time is shorter than 3 minutes, B/A tends to be low and a large coefficient of variation on the coverage ratio A is prone to occur. On the other hand, when the processing time exceeds 10 minutes, B/A conversely tends to be high and the temperature within the apparatus is prone to rise.

The rotation rate of the stirring members during external addition and mixing is not particularly limited; however, when, for the apparatus shown in FIG. 5, the volume of the processing space 9 in the apparatus is $2.0\times10^{-3}$ $m^3$, the rpm of the stirring members—when the shape of the stirring members 3 is as shown in FIG. 6—is preferably from at least 1000 rpm to not more than 3000 rpm. The coverage ratio A, B/A, and coefficient of variation on the coverage ratio A as specified for the present invention are readily obtained at from at least 1000 rpm to not more than 3000 rpm.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result a high coverage ratio A is readily obtained and the coefficient of variation on the coverage ratio A is readily reduced.

More specifically, the pre-mixing processing conditions are preferably a power of the drive member 8 of from at least 0.06 W/g to not more than 0.20 W/g and a processing time of from at least 0.5 minutes to not more than 1.5 minutes. It is difficult to obtain a satisfactorily uniform mixing in the pre-mixing when the loaded power is below 0.06 W/g or the processing time is shorter than 0.5 minutes for the pre-mixing processing conditions. When, on the other hand, the loaded power is higher than 0.20 W/g or the processing time is longer than 1.5 minutes for the pre-mixing processing conditions, the inorganic fine particles may become fixed to the magnetic toner particle surface before a satisfactorily uniform mixing has been achieved.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 7:
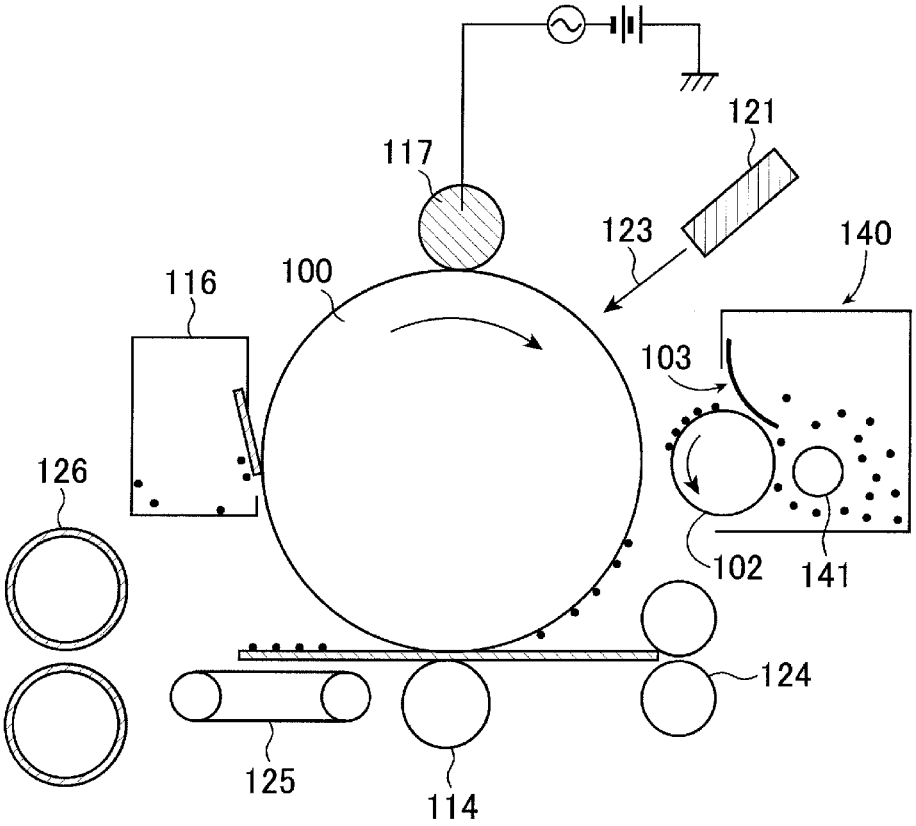
FIG. 7 is a diagram that shows an example of an image-forming apparatus.

An example of an image-forming apparatus that can advantageously use the magnetic toner of the present invention is specifically described below with reference to FIG. 7. In FIG. 7, 100 is an electrostatic latent image-bearing member (also referred to below as a photosensitive member), and the following, inter alia, are disposed on its circumference: a charging member 117 (hereinafter also called a charging roller), a developing device 140 having a toner-carrying member 102, a transfer member 114 (hereinafter also called a transfer roller), a cleaner 116, a fixing unit 126, and a register roller 124. The electrostatic latent image-bearing member 100 is charged by the charging member 117. Photoexposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a monocomponent toner to provide a toner image, and the toner image is transferred onto a transfer material by the transfer member 114, which contacts the electrostatic latent image-bearing member with the transfer material interposed therebetween. The toner image-bearing transfer material is conveyed to the fixing unit 126 and fixing on the transfer material is carried out. In addition, the toner remaining to some extent on the electrostatic latent image-bearing member is scraped off by the cleaning blade and is stored in the cleaner 116.

The methods for measuring the various properties referenced by the present invention are described below.

<Calculation of the Coverage Ratio A>

The coverage ratio A is calculated in the present invention by analyzing, using Image-Pro Plus ver. 5.0 image analysis software (Nippon Roper Kabushiki Kaisha), the image of the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the magnetic toner is sprayed onto this. Additional blowing with air is performed to remove excess magnetic toner from the specimen stub and carry out thorough drying. The specimen stub is set in the specimen holder and the specimen stub height is adjusted to 36 mm with the specimen height gauge.

(2) Setting the Conditions for Observation with the S-4800

The coverage ratio A is calculated using the image obtained by backscattered electron imaging with the S-4800. The coverage ratio A can be measured with excellent accuracy using the backscattered electron image because the inorganic fine particles are charged up less than is the case with the secondary electron image.

Introduce liquid nitrogen to the brim of the anti-contamination trap located in the S-4800 housing and allow to stand for 30 minutes. Start the "PC-SEM" of the S-4800 and perform flashing (the FE tip, which is the electron source, is cleaned). Click the acceleration voltage display area in the control panel on the screen and press the [flashing] button to open the flashing execution dialog. Confirm a flashing intensity of 2 and execute. Confirm that the emission current due to flashing is 20 to 40 μA. Insert the specimen holder in the specimen chamber of the S-4800 housing. Press [home] on the control panel to transfer the specimen holder to the observation position.

Click the acceleration voltage display area to open the HV setting dialog and set the acceleration voltage to [0.8 kV] and the emission current to [20 μA]. In the [base] tab of the operation panel, set signal selection to [SE]; select [upper (U)] and [+BSE] for the SE detector; and select [L.A. 100] in the selection box to the right of [+BSE] to go into the observation mode using the backscattered electron image. Similarly, in the [base] tab of the operation panel, set the probe current of the electron optical system condition block to [Normal]; set the focus mode to [UHR]; and set WD to [3.0 mm]. Push the [ON] button in the acceleration voltage display area of the control panel and apply the acceleration voltage.

(3) Calculation of the Number-Average Particle Diameter (D1) of the Magnetic Toner Set the magnification to 5000× (5 k) by dragging within the magnification indicator area of the control panel. Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus with the autofocus. Focus by repeating this operation an additional two times.

After this, determine the number-average particle diameter (D1) by measuring the particle diameter at 300 magnetic toner particles. The particle diameter of the individual particle is taken to be the maximum diameter when the magnetic toner particle is observed.

(4) Focus Adjustment

For particles with a number-average particle diameter (D1) obtained in (3) of ±0.1 μm, with the center of the maximum diameter adjusted to the center of the measurement screen, drag within the magnification indication area of the control panel to set the magnification to 10000× (10 k). Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus using autofocus. Then set the magnification to 50000× (50 k); carry out focus adjustment as above using the focus knob and the STIGMA/ALIGNMENT knob; and re-focus using autofocus. Focus by repeating this operation. Here, because the accuracy of the coverage ratio measurement is prone to decline when the observation plane has a large tilt angle, carry out the analysis by making a selection with the least tilt in the surface by making a selection during focus adjustment in which the entire observation plane is simultaneously in focus.

(5) Image Capture

Carry out brightness adjustment using the ABC mode and take a photograph with a size of 640×480 pixels and store. Carry out the analysis described below using this image file. Take one photograph for each magnetic toner particle and obtain images for at least 30 magnetic toner particles.

(6) Image Analysis

The coverage ratio A is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter less than 5 nm and an inorganic fine particle with a particle diameter greater than 50 nm is present within a partition, calculation of the coverage ratio A is not performed for this partition.

The analysis conditions with the Image-Pro Plus ver. 5.0 image analysis software are as follows.

Software: Image-ProPlus5.1J

From "measurement" in the tool-bar, select "count/size" and then "option" and set the binarization conditions. Select 8 links in the object extraction option and set smoothing to 0. In addition, preliminary screening, fill vacancies, and envelope are not selected and the "exclusion of boundary line" is set to "none". Select "measurement items" from "measurement" in the tool-bar and enter 2 to $10^7$ for the area screening range.

The coverage ratio is calculated by marking out a square zone. Here, the area (C) of the zone is made 24000 to 26000 pixels. Automatic binarization is performed by "processing"-binarization and the total area (D) of the silica-free zone is calculated.

The coverage ratio a is calculated using the following formula from the area C of the square zone and the total area D of the silica-free zone.

$$\text{coverage ratio } a(\%)=100-(D/C\times 100)$$

As noted above, calculation of the coverage ratio a is carried out for at least 30 magnetic toner particles. The average value of all the obtained data is taken to be the coverage ratio A of the present invention.

<The Coefficient of Variation on the Coverage Ratio A>

The coefficient of variation on the coverage ratio A is determined in the present invention as follows. The coefficient of variation on the coverage ratio A is obtained using the following formula letting σ(A) be the standard deviation on all the coverage ratio data used in the calculation of the coverage ratio A described above.

$$\text{coefficient of variation}(\%)=\{\sigma(A)/A\}\times 100$$

<Calculation of the Coverage Ratio B>

The coverage ratio B is calculated by first removing the unfixed inorganic fine particles on the magnetic toner surface and thereafter carrying out the same procedure as followed for the calculation of the coverage ratio A.

(1) Removal of the Unfixed Inorganic Fine Particles

The unfixed inorganic fine particles are removed as described below. The present inventors investigated and then set these removal conditions in order to thoroughly remove the inorganic fine particles other than those embedded in the toner surface.

Figure 8:
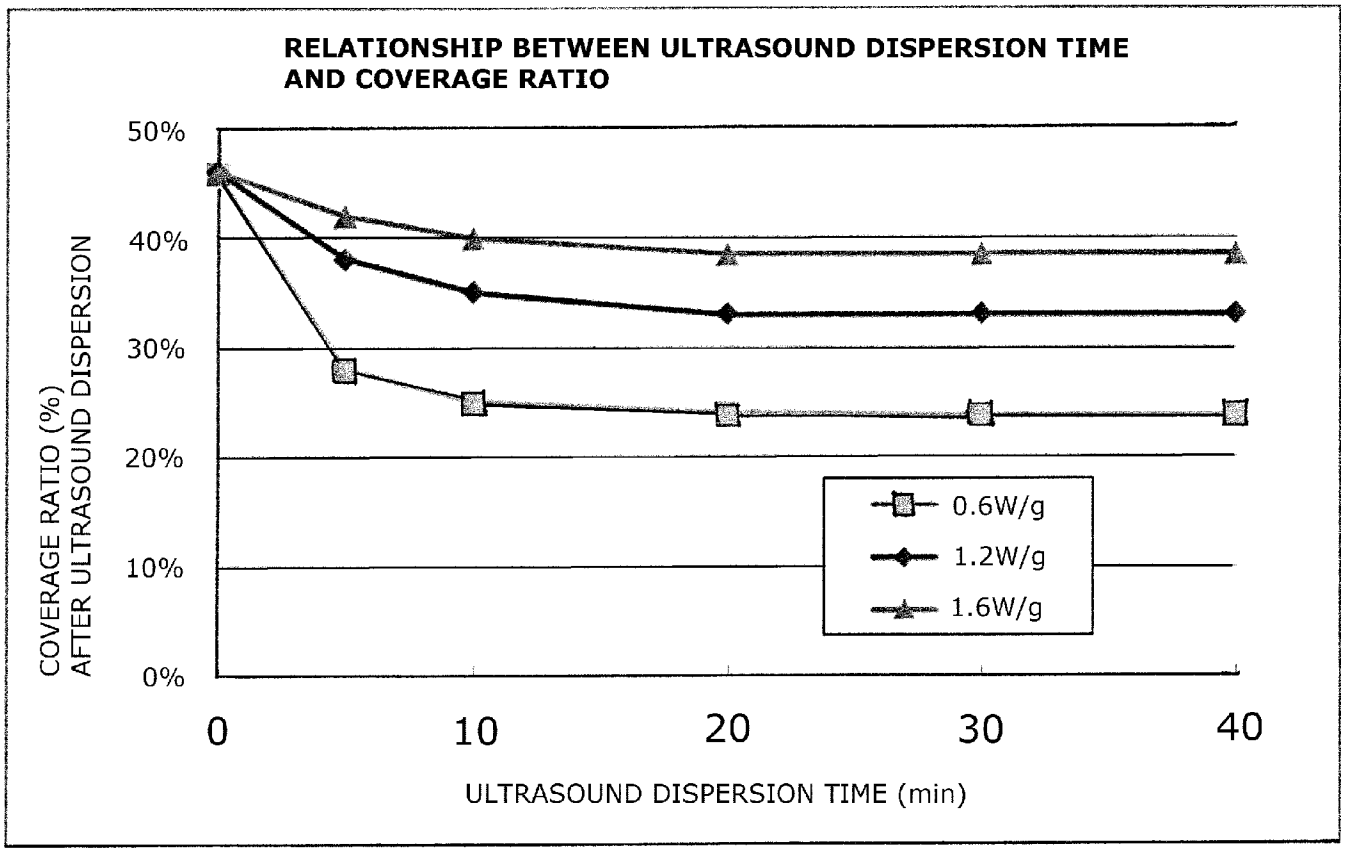
FIG. 8 is a diagram that shows an example of the relationship between the ultrasound dispersion time and the coverage ratio.

As an example, FIG. 8 shows the relationship between the ultrasound dispersion time and the coverage ratio calculated post-ultrasound dispersion, for magnetic toners in which the coverage ratio A was brought to 46% using the apparatus shown in FIG. 5 at three different external addition intensities. FIG. 8 was constructed by calculating, using the same procedure as for the calculation of coverage ratio A as described above, the coverage ratio of a magnetic toner provided by removing the inorganic fine particles by ultrasound dispersion by the method described below and then drying.

FIG. 8 demonstrates that the coverage ratio declines in association with removal of the inorganic fine particles by ultrasound dispersion and that, for all of the external addition intensities, the coverage ratio is brought to an approximately constant value by ultrasound dispersion for 20 minutes. Based on this, ultrasound dispersion for 30 minutes was regarded as providing a thorough removal of the inorganic fine particles other than the inorganic fine particles embedded in the toner surface and the thereby obtained coverage ratio was defined as coverage ratio B.

Considered in greater detail, 16.0 g of water and 4.0 g of Contaminon N (a neutral detergent from Wako Pure Chemical Industries, Ltd., product No. 037-10361) are introduced into a 30 mL glass vial and are thoroughly mixed. 1.50 g of the magnetic toner is introduced into the resulting solution and the magnetic toner is completely submerged by applying a magnet at the bottom. After this, the magnet is moved around in order to condition the magnetic toner to the solution and remove air bubbles.

The tip of a UH-50 ultrasound oscillator (from SMT Co., Ltd., the tip used is a titanium alloy tip with a tip diameter ϕ of 6 mm) is inserted so it is in the center of the vial and resides at a height of 5 mm from the bottom of the vial, and the inorganic fine particles are removed by ultrasound dispersion. After the application of ultrasound for 30 minutes, the entire amount of the magnetic toner is removed and dried. During this time, as little heat as possible is applied while carrying out vacuum drying at not more than 30° C.

(2) Calculation of the Coverage Ratio B

After the drying as described above, the coverage ratio of the magnetic toner is calculated as for the coverage ratio A described above, to obtain the coverage ratio B.

<Method of Measuring the Number-Average Particle Diameter of the Primary Particles of the Inorganic Fine Particles>

The number-average particle diameter of the primary particles of the inorganic fine particles is calculated from the inorganic fine particle image on the magnetic toner surface taken with Hitachi's S-4800 ultrahigh resolution field emission scanning electron microscope (Hitachi High-Technologies Corporation). The conditions for image acquisition with the S-4800 are as follows.

The same steps (1) to (3) as described above in "Calculation of the coverage ratio A" are carried out; focusing is performed by carrying out focus adjustment at a 50000× magnification of the magnetic toner surface as in (4); and the brightness is then adjusted using the ABC mode. This is followed by bringing the magnification to 100000×; performing focus adjustment using the focus knob and STIGMA/

ALIGNMENT knobs as in (4); and focusing autofocus. The focus adjustment process is repeated to achieve focus at 100000×.

After this, the particle diameter is measured on at least 300 inorganic fine particles on the magnetic toner surface and the primary particle number-average particle diameter (D1) is determined. Here, because the inorganic fine particles are also present as aggregates, the maximum diameter is determined on what can be identified as the primary particle, and the primary particle number-average particle diameter (D1) is obtained by taking the arithmetic average of the obtained maximum diameters.

<Method for Measuring the Number of Large-Diameter Alumina Fine Particle and Large-Diameter Titania Fine Particle (X and Y)>

The number of large-diameter alumina fine particle and large-diameter titania fine particle is measured using Hitachi's S-4800 ultrahigh resolution field emission scanning electron microscope (Hitachi High-Technologies Corporation). The observation conditions are the same as described above in (1) and (2) in "Calculation of the coverage ratio A". The photomagnification is set to 8000×; the magnetic toner particles are photographed; and the number of alumina fine particle and titania fine particle having a particle diameter of from at least 100 nm to not more than 800 nm present per magnetic toner particle is measured. Here, the particle diameter is taken to be the maximum diameter of the particle. Prior to sample extraction, a preliminary elementary analysis is performed using an energy-dispersive x-ray analyzer (from EDAX Inc.), and extraction is performed after confirming whether the particular particle is an alumina fine particle or titania fine particle. The evaluation is carried out on 500 magnetic toner particles in the photograph, and for each of the 500 the number of alumina fine particle and titania fine particle having a diameter of from at least 100 nm to not more than 800 nm is counted (this is X in formulas (1) and (2)). In addition, when this is done, just the top surface of the toner on the specimen stub can be checked in the observation, and the inorganic fine particle in the region in contact with the specimen stub cannot be checked. Here, when 1 alumina fine particle or titania fine particle having a particle diameter of from at least 100 nm to not more than 800 nm can be observed per magnetic toner particle, this is doubled and it is stipulated that there are 2 alumina fine particles or titania fine particles each of which has a particle diameter of from at least 100 nm to not more than 800 nm on this magnetic toner particle. For example, when, during the observation of 500 toner particles, 1600 alumina fine particles and/or titania fine particles each of which has a particle diameter of from at least 100 nm to not more than 800 nm are observed, 3200 (1600×2) alumina fine particles and/or titania fine particles each of which has a particle diameter of from at least 100 nm to not more than 800 are stipulated to be actually present on the surface of the magnetic toner particles. In this case, the number of alumina fine particles and/or titania particles each of which has a particle diameter of from at least 100 nm to not more than 800 nm present on the surface of the magnetic toner particles per magnetic toner particle then becomes 6.4 (3200/500).

Similarly, the unfixed fine particles are removed using the method in "(1) Removal of the unfixed inorganic fine particles" in <Calculation of the coverage ratio B>, and the number of alumina fine particles and/or titania fine particles each of which has a particle diameter of from at least 100 nm to not more than 800 nm and is fixed to the magnetic toner measured in the same manner as described above (this is Y in formulas (1) and (2)).

<Method for Measuring the Weight-Average Particle Diameter (D4) of the Magnetic Toner>

The weight-average particle diameter (D4) of the magnetic toner is calculated as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10° C. and not more than 40° C.

(6) Using a pipette, the dispersed toner-containing aqueous electrolyte solution prepared in (5) is dripped into the round-bottom beaker set in the sample stand as described in (1) with adjustment to provide a measurement concentration of about 5%. Measurement is then performed until the number of measured particles reaches 50000.

(7) The measurement data is analyzed by the previously cited dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

EXAMPLES

The present invention is more specifically described through the examples and comparative examples provided below, but the present invention is in no way restricted to these. The "parts" and "%" in the examples and comparative examples, unless specifically indicated otherwise, are on a mass basis.

<Magnetic Body 1 Production Example>

An aqueous solution containing ferrous hydroxide was prepared by mixing the following in an aqueous solution of ferrous sulfate: a sodium hydroxide solution at 1.1 equivalent with reference to the iron, and $SiO_2$ in an amount that provided 1.20 mass % as silicon with reference to the iron. The pH of the aqueous solution was brought to 8.0 and an oxidation reaction was run at 85° C. while blowing in air to prepare a slurry containing seed crystals. An aqueous ferrous sulfate solution was then added to provide 1.0 equivalent with reference to the amount of the starting alkali (sodium component in the sodium hydroxide) in this slurry and an oxidation reaction was subsequently run while blowing in air and maintaining the slurry at pH 8.5 to obtain a slurry containing magnetic iron oxide. This slurry was filtered, washed, dried, and ground to obtain a spherical magnetic body 1 that had a volume-average particle diameter of 0.22 μm and a intensity of magnetization of 66.1 $Am^2/kg$ and residual magnetization of 5.9 $Am^2/kg$ for a magnetic field of 795.8 kA/m.

<Production of Toner Particle 1>

| | |
|---|---|
| styrene/n-butyl acrylate copolymer (styrene and n-butyl acrylate mass ratio = 78:22, glass-transition temperature (Tg) = 58° C., peak molecular weight = 8500) | 100 mass parts |
| magnetic body 1 | 95 mass parts |
| polyethylene wax (melting point: 102° C.) | 5 mass parts |
| iron complex of monoazo dye (T-77: Hodogaya Chemical Co., Ltd.) | 2.0 mass parts |

The starting materials listed above were preliminarily mixed using an FM10C HENSCHEL mixer (Mitsui Miike Chemical Engineering Machinery Co., Ltd.). This was followed by kneading with a twin-screw kneader/extruder (PCM-30, Ikegai Ironworks Corporation) set at a rotation rate of 250 rpm with the set temperature being adjusted to provide a direct temperature in the vicinity of the outlet for the kneaded material of 145° C.

The resulting melt-kneaded material was cooled; the cooled melt-kneaded material was coarsely pulverized with a cutter mill; the resulting coarsely pulverized material was finely pulverized using a Turbo Mill T-250 (Turbo Kogyo Co., Ltd.) at a feed rate of 25.0 kg/hr with the air temperature adjusted to provide an exhaust gas temperature of 38° C.; and classification was performed using a Coanda effect-based multifraction classifier to obtain a magnetic toner particle 1 having a weight-average particle diameter (D4) of 8.4 μm.

<Magnetic Toner Particle 2 Production Example>

100 mass parts of the magnetic toner particle 1 and 0.5 mass parts of a hydrophobic silica were introduced into an FM10C HENSCHEL mixer (Mitsui Miike Chemical Engineering Machinery Co., Ltd.) and were mixed and stirred for 2 minutes at a rotation rate of 3000 rpm. The hydrophobic silica used was obtained by subjecting 100 mass parts of a silica with a primary particle number-average particle diameter (D1) of 12 nm and a BET specific surface area of 200 $m^2/g$ to surface treatment with 10 mass parts hexamethyldisilazane and then treatment with 10 mass parts dimethylsilicone oil.

Then, this mixed and stirred material was subjected to surface modification using a Meteorainbow (Nippon Pneumatic Mfg. Co., Ltd.), which is a device that carries out the surface modification of magnetic toner particles using a hot wind blast. The surface modification conditions were a starting material feed rate of 2 kg/hr, a hot wind flow rate of 700 L/min, and a hot wind ejection temperature of 300° C. Magnetic toner particle 2 was obtained by carrying out this hot wind treatment.

<Magnetic Toner Particle 3 Production Example>

A magnetic toner particle 3 was obtained proceeding as in the production of magnetic toner particle 2, but using 1.5 mass parts for the amount of addition of the hydrophobic silica added in the Magnetic Toner Particle 2 Production Example.

<Magnetic Toner Particle 4 Production Example>

A magnetic toner particle 4 was obtained proceeding as in the production of magnetic toner particle 2, but using 2.0 mass parts for the amount of addition of the hydrophobic silica added in the production of magnetic toner particle 2.

<Magnetic Toner 1 Production Example>

An external addition and mixing process was carried out using the apparatus shown in FIG. 5 on the magnetic toner particle 1 provided by Magnetic Toner Particle 1 Production Example.

In this example, the apparatus shown in FIG. 5 was used, in which the diameter of the inner circumference of the main casing 1 was 130 mm; the apparatus used had a volume for the processing space 9 of $2.0\times10^{-3}$ $m^3$; the rated power for the drive member 8 was 5.5 kW; and the stirring member 3 had the shape given in FIG. 6. The overlap width d in FIG. 6 between the stirring member 3*a* and the stirring member 3*b* was 0.25 D with respect to the maximum width D of the stirring member 3, and the clearance between the stirring member 3 and the inner circumference of the main casing 1 was 3.0 mm.

100 mass parts (500 g) of magnetic toner particle 1, 2.00 mass parts of the silica fine particle 1 described below, and 0.40 mass parts of alumina fine particle 1 described below were introduced into the apparatus shown in FIG. 5 having the apparatus structure described above.

Silica fine particle 1 was obtained by treating 100 mass parts of a silica with a BET specific surface area of 130 $m^2/g$ and a primary particle number-average particle diameter (D1) of 16 nm with 10 mass parts hexamethyldisilazane and then with 10 mass parts dimethylsilicone oil. Alumina fine particle 1 had a BET specific surface area of 8 $m^2/g$ and a primary particle number-average particle diameter (D1) of 400 nm and had been treated with 10 mass % isobutyltrimethoxysilane.

A pre-mixing was carried out after the introduction of the magnetic toner particles, the silica fine particles, and the alumina fine particles in order to uniformly mix the magnetic toner particles, the silica fine particles, and the alumina fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.0 W/g (drive member 8 rotation rate of 1800 rpm). The conditions for the external addition and mixing process are shown in Table 1.

After the external addition and mixing process, the coarse particles and so forth were removed using a circular vibrating screen equipped with a screen having a diameter of 500 mm and an aperture of 75 μm to obtain magnetic toner 1. A value of 18 nm was obtained when magnetic toner 1 was submitted to magnification and observation with a scanning electron microscope and the number-average primary particle diameter of the silica fine particles on the magnetic toner surface was measured, while a value of 400 nm was obtained for the primary particle number-average particle diameter of the alumina fine particles. The external addition conditions for magnetic toner 1 are given in Table 1, and the magnetic toner properties are given in Table 2.

<Magnetic Toner 2 to 36 Production Examples and Comparative Magnetic Toner 1 to 50 Production Examples>

Magnetic toners 2 to 36 and comparative magnetic toners 1 to 50 were obtained using the magnetic toner particles shown in Table 1 in the Magnetic Toner 1 Production Example in place of magnetic toner particle and by performing respective external addition processing using the external addition formulations, external addition apparatuses, and external addition conditions shown in Table 1. Table 2 gives the properties of each magnetic toner, the number of alumina fine particles and/or titania fine particles each of which has a particle diameter of from at least 100 nm to not more than 800 nm present on the surface of the magnetic toner particles per magnetic toner particle, and the number-average particle diameter of the added primary particles.

The titania fine particles, alumina fine particles, strontium titanate, and zinc stearate referenced in Table 1 are as follows.

alumina fine particle 1: BET specific surface area=8 $m^2/g$, primary particle number-average particle diameter (D1)=400 nm, treated with 10 mass % isobutyltrimethoxysilane alumina fine particle 2: BET specific surface area=30 $m^2/g$, primary particle number-average particle diameter (D1)=100 nm, treated with 10 mass % isobutyltrimethoxysilane alumina fine particle 3: BET specific surface area=5 $m^2/g$, primary particle number-average particle diameter (D1)=600 nm, treated with 10 mass % isobutyltrimethoxysilane alumina fine particle 4: BET specific surface area=4 $m^2/g$, primary particle number-average particle diameter (D1)=800 nm, treated with 10 mass % isobutyltrimethoxysilane alumina fine particle 5: BET specific surface area=4.5 $m^2/g$, primary particle number-average particle diameter (D1)=700 nm, treated with 10 mass % isobutyltrimethoxysilane alumina fine particle 6: AKP-53 (Sumitomo Chemical Co., Ltd., primary particle number-average particle diameter (D1)= 210 nm)

alumina fine particle 7: BET specific surface area=32 $m^2/g$, primary particle number-average particle diameter (D1)=90 nm, treated with 10 mass % isobutyltrimethoxysilane alumina fine particle 8: BET specific surface area=3.9 $m^2/g$, primary particle number-average particle diameter (D1)=810 nm, treated with 10 mass % isobutyltrimethoxysilane alumina fine particle 9: AKP-3000 (Sumitomo Chemical Co., Ltd., primary particle number-average particle diameter (D1)=570 nm)

titania fine particle 1: anatase-type titanium oxide, BET specific surface area=9 $m^2/g$, primary particle number-average particle diameter (D1)=400 nm, treated with 12 mass % isobutyltrimethoxysilane strontium titanate: BET specific surface area=32 $m^2/g$, primary particle number-average particle diameter (D1)=70 nm, rectangular parallelepiped particles, no hydrophobic treatment zinc stearate: MZ2 (NOF Corporation, primary particle number-average particle diameter D1: 900 nm)

With comparative magnetic toners 13 to 17, no pre-mixing was performed and the external addition and mixing process was carried out directly after introduction. The hybridizer referenced in Table 1 is the Hybridizer Model 1 (Nara Machinery Co., Ltd.); the HENSCHEL mixer referenced in Table 1 is the FM10C (Mitsui Miike Chemical Engineering Machinery Co., Ltd.); and the spherical mixing tank referenced in Table 1 is a Q Model 20 L (Mitsui Mining Co., Ltd., vane-shaped turbine).

Supplemental information for the Magnetic Toner 2, 3, 5, 6, 8, and 27 to 31 Production Examples and the Comparative Magnetic Toner 18 Production Example is given in the following.

<Magnetic Toner 2 Production Example>

Magnetic toner 2 was obtained proceeding as in the Magnetic Toner 1 Production Example, but changing silica fine particle 1 to silica fine particle 2, which was obtained by subjecting a silica having a BET specific surface area of 200 $m^2/g$ and a primary particle number-average particle diameter (D1) of 12 nm to the same surface treatment as for silica fine particle 1. A value of 14 nm was obtained when magnetic toner 2 was submitted to magnification and observation with a scanning electron microscope and the primary particle number-average particle diameter of the silica fine particles on the magnetic toner surface was measured.

<Magnetic Toner 3 Production Example>

Magnetic toner 3 was obtained proceeding as in the Magnetic Toner 1 Production Example, but changing silica fine particle 1 to silica fine particle 3, which was obtained by subjecting a silica having a BET specific surface area of 90 $m^2/g$ and a primary particle number-average particle diameter (D1) of 25 nm to the same surface treatment as for silica fine particle 1. A value of 28 nm was obtained when magnetic toner 3 was submitted to magnification and observation with a scanning electron microscope and the primary particle number-average particle diameter of the silica fine particles on the magnetic toner surface was measured.

<Magnetic Toner 5 Production Example>

Magnetic toner 5 was obtained proceeding as in the Magnetic Toner 4 Production Example, but changing silica fine particle 1 to silica fine particle 2. A value of 14 nm was obtained when magnetic toner 5 was submitted to magnification and observation with a scanning electron microscope and the primary particle number-average particle diameter of the silica fine particles on the magnetic toner surface was measured.

<Magnetic Toner 6 Production Example>

Magnetic toner 6 was obtained proceeding as in the Magnetic Toner 4 Production Example, but changing silica fine particle 1 to silica fine particle 3. A value of 28 nm was obtained when magnetic toner 6 was submitted to magnification and observation with a scanning electron microscope and the primary particle number-average particle diameter of the silica fine particles on the magnetic toner surface was measured.

<Magnetic Toner 8 Production Example>

Magnetic toner 8 was obtained proceeding as in the Magnetic Toner 7 Production Example, but changing silica fine particle 1 to silica fine particle 3. A value of 28 nm was obtained when magnetic toner 8 was submitted to magnification and observation with a scanning electron microscope and the primary particle number-average particle diameter of the silica fine particles on the magnetic toner surface was measured.

<Magnetic Toner 27 Production Example>

The external addition and mixing process was performed according to the following procedure using the same apparatus structure (apparatus in FIG. 5) as in the Magnetic Toner 1 Production Example.

100 mass parts of magnetic toner particle 1 and 0.40 mass parts of alumina fine particle 1 were introduced as in the Magnetic Toner 1 Production Example and the same pre-mixing as in Magnetic Toner 1 Production Example was then performed.

In the external addition and mixing process carried out once pre-mixing was finished, processing was performed for a processing time of 5 minutes while adjusting the peripheral velocity of the outermost end of the stirring member 3 so as to provide a constant drive member 8 power of 1.6 W/g (drive member 8 rotation rate of 2500 rpm), after which the mixing process was temporarily stopped. The supplementary introduction of silica fine particle 1 (1.50 mass parts with reference to 100 mass parts of the magnetic toner particle) was then performed, followed by again processing for a processing time of 5 minutes while adjusting the peripheral velocity of the outermost end of the stirring member 3 so as to provide a constant drive member 8 power of 1.6 W/g (drive member 8 rotation rate of 2500 rpm), thus providing a total external addition and mixing process time of 10 minutes.

After the external addition and mixing process, the coarse particles and so forth were removed using a circular vibrating screen as in the Magnetic Toner 1 Production Example to obtain magnetic toner 27.

<Magnetic Toner 28 to 31 Production Examples>

Magnetic toners 28 to 31 were obtained proceeding as in the Magnetic Toner 27 Production Example, but changing the external addition formulation and/or external addition conditions in Magnetic Toner 27 Production Example.

<Comparative Magnetic Toner 18 Production Example>

Comparative magnetic toner 18 was obtained proceeding as in the Magnetic Toner 1 Production Example, but changing silica fine particle 1 to silica fine particle 4, which was obtained by subjecting a silica having a BET specific surface area of 30 $m^2/g$ and a primary particle number-average particle diameter (D1) of 51 nm to the same surface treatment as for silica fine particle 1. A value of 53 nm was obtained when comparative magnetic toner 18 was submitted to magnification and observation with a scanning electron microscope and the primary particle number-average particle diameter of the silica fine particles on the magnetic toner surface was measured.

TABLE 1

| Magnetic toner No. | Magnetic toner particle No. | alumina/titania fine particle | External additive (mass parts) silica | alumina | titania | Number-average particle diameter of the primary particles of the external additive (nm) alumina | titania | External addition apparatus | External addition conditions Mixing conditions | Mixing time | External addition conditions for the alumina fine particles and/or titania fine particles |
|---|---|---|---|---|---|---|---|---|---|---|---|
| 1 | 1 | alumina fine particle 1 | 2.00 | 0.40 | — | 400 | — | FIG. 5 | 1.0 W/g(1800 rpm) | 5 min | A |
| 2 | 1 | alumina fine particle 1 | 2.00 | 0.40 | — | 400 | — | FIG. 5 | 1.0 W/g(1800 rpm) | 5 min | A |
| 3 | 1 | alumina fine particle 1 | 2.00 | 0.40 | — | 400 | — | FIG. 5 | 1.0 W/g(1800 rpm) | 5 min | A |
| 4 | 1 | titania fine particle 1 | 2.00 | — | 0.40 | — | 400 | FIG. 5 | 1.0 W/g(1800 rpm) | 5 min | A |
| 5 | 1 | titania fine particle 1 | 2.00 | — | 0.40 | — | 400 | FIG. 5 | 1.0 W/g(1800 rpm) | 5 min | A |
| 6 | 1 | titania fine particle 1 | 2.00 | — | 0.40 | — | 400 | FIG. 5 | 1.0 W/g(1800 rpm) | 5 min | A |
| 7 | 1 | alumina fine particle 1 | 1.80 | 0.40 | — | 400 | — | FIG. 5 | 1.0 W/g(1800 rpm) | 5 min | A |
| 8 | 1 | alumina fine particle 1 | 1.80 | 0.40 | — | 400 | — | FIG. 5 | 1.0 W/g(1800 rpm) | 5 min | A |
| 9 | 1 | alumina fine particle 1 | 1.50 | 0.40 | — | 400 | — | FIG. 5 | 1.0 W/g(1800 rpm) | 5 min | A |
| 10 | 1 | alumina fine particle 1 | 2.60 | 0.40 | — | 400 | — | FIG. 5 | 1.0 W/g(1800 rpm) | 5 min | A |
| 11 | 1 | alumina fine particle 2 | 1.50 | 0.01 | — | 100 | — | FIG. 5 | 1.6 W/g(2500 rpm) | 5 min | A |
| 12 | 1 | alumina fine particle 4 | 1.50 | 0.30 | — | 800 | — | FIG. 5 | 1.6 W/g(2500 rpm) | 5 min | A |
| 13 | 1 | alumina fine particle 2 | 1.60 | 0.07 | — | 100 | — | FIG. 5 | 1.6 W/g(2500 rpm) | 5 min | A |
| 14 | 1 | alumina fine particle 3 | 1.60 | 15.00 | — | 600 | — | FIG. 5 | 1.6 W/g(2500 rpm) | 5 min | A |
| 15 | 1 | alumina fine particle 2 | 1.50 | 0.01 | — | 100 | — | FIG. 5 | 0.6 W/g(1400 rpm) | 5 min | A |
| 16 | 1 | alumina fine particle 4 | 1.50 | 0.30 | — | 800 | — | FIG. 5 | 0.6 W/g(1400 rpm) | 5 min | A |
| 17 | 1 | alumina fine particle 2 | 1.50 | 0.07 | — | 100 | — | FIG. 5 | 0.6 W/g(1400 rpm) | 5 min | A |

TABLE 1-continued

| | Magnetic toner particle No. | alumina/titania fine particle | External additive (mass parts) silica | alumina | titania | Number-average particle diameter of the primary particles of the external additive (nm) alumina | titania | External addition apparatus | External addition conditions Mixing conditions | Mixing time | External addition conditions for the alumina fine particles and/or titania fine particles |
|---|---|---|---|---|---|---|---|---|---|---|---|
| 18 | 1 | alumina fine particle 3 | 1.50 | 15.00 | — | 600 | — | FIG. 5 | 0.6 W/g(1400 rpm) | 5 min | A |
| 19 | 1 | alumina fine particle 2 | 2.60 | 0.01 | — | 100 | — | FIG. 5 | 1.6 W/g(2500 rpm) | 5 min | A |
| 20 | 1 | alumina fine particle 4 | 2.60 | 0.30 | — | 800 | — | FIG. 5 | 1.6 W/g(2500 rpm) | 5 min | A |
| 21 | 1 | alumina fine particle 2 | 2.60 | 0.07 | — | 100 | — | FIG. 5 | 1.6 W/g(2500 rpm) | 5 min | A |
| 22 | 1 | alumina fine particle 3 | 2.60 | 15.00 | — | 600 | — | FIG. 5 | 1.6 W/g(2500 rpm) | 5 min | A |
| 23 | 1 | alumina fine particle 2 | 2.60 | 0.01 | — | 100 | — | FIG. 5 | 0.6 W/g(1400 rpm) | 5 min | A |
| 24 | 1 | alumina fine particle 4 | 2.60 | 0.30 | — | 800 | — | FIG. 5 | 0.6 W/g(1400 rpm) | 5 min | A |
| 25 | 1 | alumina fine particle 2 | 2.60 | 0.07 | — | 100 | — | FIG. 5 | 0.6 W/g(1400 rpm) | 5 min | A |
| 26 | 1 | alumina fine particle 3 | 2.60 | 15.00 | — | 600 | — | FIG. 5 | 0.6 W/g(1400 rpm) | 5 min | A |
| 27 | 1 | alumina fine particle 1 | 1.50 | 0.40 | — | 400 | — | FIG. 5 | [1]1.6 W/g(2500 rpm)<br>[2]1.6 W/g(2500 rpm) | [1]5 min<br>[2]5 min | B |
| 28 | 1 | alumina fine particle 1 | 1.50 | 0.40 | — | 400 | — | FIG. 5 | [1]1.6 W/g(2500 rpm)<br>[2]0.6 W/g(1400 rpm) | [1]5 min<br>[2]5 min | B |
| 29 | 1 | alumina fine particle 1 | 2.60 | 0.40 | — | 400 | — | FIG. 5 | [1]1.6 W/g(2500 rpm)<br>[2]1.6 W/g(2500 rpm) | [1]5 min<br>[2]5 min | B |
| 30 | 1 | alumina fine particle 1 | 2.60 | 0.40 | — | 400 | — | FIG. 5 | [1]1.6 W/g(2500 rpm)<br>[2]0.6 W/g(1400 rpm) | [1]5 min<br>[2]5 min | B |
| 31 | 1 | alumina fine particle 1 | 2.20 | 0.40 | — | 400 | — | FIG. 5 | [1]2.0 W/g(3000 rpm)<br>[2]1.6 W/g(2500 rpm) | [1]5 min<br>[2]5 min | B |
| 32 | 1 | alumina fine particle 1 | 2.30 | 0.40 | — | 400 | — | Hybridizer | 6000 rpm | 5 min | A |
| 33 | 1 | alumina fine particle 1 | 2.30 | 0.40 | — | 400 | — | Hybridizer | 7000 rpm | 5 min | A |
| 34 | 1 | alumina fine particle 5 | 2.00 | 18.00 | — | 700 | — | FIG. 5 | 1.0 W/g(1800 rpm) | 5 min | A |
| 35 | 1 | alumina fine particle 5 | 2.00 | 20.00 | — | 700 | — | FIG. 5 | 1.0 W/g(1800 rpm) | 5 min | A |
| 36 | 1 | alumina fine particle 1<br>titania fine particle 1 | 2.00 | 0.20 | 0.20 | 400 | 400 | FIG. 5 | 1.0 W/g(1800 rpm) | 5 min | A |
| Comparative magnetic toner No. | | | | | | | | | | | |
| 1 | 1 | alumina fine particle 1 | 1.50 | 0.40 | — | 400 | — | Henschel mixer | 3000 rpm | 2 min | A |
| 2 | 1 | alumina fine particle 1 | 1.50 | 0.40 | — | 400 | — | Henschel mixer | 4000 rpm | 5 min | A |
| 3 | 1 | alumina fine particle 1 | 2.60 | 0.40 | — | 400 | — | Henschel mixer | 3000 rpm | 2 min | A |
| 4 | 1 | alumina fine particle 1 | 2.60 | 0.40 | — | 400 | — | Henschel mixer | 4000 rpm | 5 min | A |
| 5 | 1 | alumina fine particle 1 | 3.50 | 0.40 | — | 400 | — | Henschel mixer | 3000 rpm | 2 min | A |
| 6 | 1 | alumina fine particle 1 | 1.50 | 0.40 | — | 400 | — | Hybridizer | 6000 rpm | 5 min | A |
| 7 | 1 | alumina fine particle 1 | 1.50 | 0.40 | — | 400 | — | Hybridizer | 7000 rpm | 8 min | A |
| 8 | 2 | alumina fine particle 1 | 1.00 | 0.40 | — | 400 | — | Henschel mixer | 4000 rpm | 2 min | A |
| 9 | 2 | alumina fine particle 1 | 2.00 | 0.40 | — | 400 | — | Henschel mixer | 4000 rpm | 2 min | A |
| 10 | 3 | alumina fine particle 1 | 1.00 | 0.40 | — | 400 | — | Henschel mixer | 4000 rpm | 2 min | A |
| 11 | 3 | alumina fine particle 1 | 2.00 | 0.40 | — | 400 | — | Henschel mixer | 4000 rpm | 2 min | A |
| 12 | 4 | alumina fine particle 1 | 2.00 | 0.40 | — | 400 | — | Henschel mixer | 4000 rpm | 2 min | A |
| 13 | 1 | alumina fine particle 1 | 1.50 | 0.40 | — | 400 | — | FIG. 5 | no pre-mixing<br>0.6 W/g(1400 rpm) | 3 min | A |
| 14 | 1 | alumina fine particle 1 | 1.20 | 0.40 | — | 400 | — | FIG. 5 | no pre-mixing<br>0.6 W/g(1400 rpm) | 3 min | A |
| 15 | 1 | alumina fine particle 1 | 3.10 | 0.40 | — | 400 | — | FIG. 5 | no pre-mixing<br>1.6 W/g(2500 rpm) | 3 min | A |
| 16 | 1 | alumina fine particle 1 | 2.60 | 0.40 | — | 400 | — | FIG. 5 | no pre-mixing<br>0.6 W/g(1400 rpm) | 3 min | A |
| 17 | 1 | alumina fine particle 1 | 1.50 | 0.40 | — | 400 | — | FIG. 5 | no pre-mixing<br>2.2 W/g(3300 rpm) | 5 min | A |
| 18 | 1 | alumina fine particle 1 | 2.00 | 0.40 | — | 400 | — | FIG. 5 | 1.0 W/g(1800 rpm) | 5 min | A |
| 19 | 1 | alumina fine particle 1 | 2.00 | 0.01 | — | 400 | — | FIG. 5 | 1.0 W/g(1800 rpm) | 5 min | A |
| 20 | 1 | alumina fine particle 1 | 2.00 | 4.80 | — | 400 | — | FIG. 5 | 1.0 W/g(1800 rpm) | 5 min | A |
| 21 | 1 | titania fine particle 1 | 2.00 | — | 0.01 | — | 400 | FIG. 5 | 1.0 W/g(1800 rpm) | 5 min | A |
| 22 | 1 | titania fine particle 1 | 2.00 | — | 4.80 | — | 400 | FIG. 5 | 1.0 W/g(1800 rpm) | 5 min | A |
| 23 | 1 | alumina fine particle 7 | 2.18 | 0.40 | — | 90 | — | FIG. 5 | 1.0 W/g(1800 rpm) | 5 min | A |
| 24 | 1 | alumina fine particle 8 | 2.18 | 0.40 | — | 810 | — | FIG. 5 | 1.0 W/g(1800 rpm) | 5 min | A |
| 25 | 1 | alumina fine particle 1 | 1.50 | 0.01 | — | 400 | — | FIG. 5 | 1.6 W/g(2500 rpm) | 5 min | A |
| 26 | 1 | alumina fine particle 1 | 1.63 | 4.80 | — | 400 | — | FIG. 5 | 1.6 W/g(2500 rpm) | 5 min | A |
| 27 | 1 | titania fine particle 1 | 1.50 | — | 0.01 | — | 400 | FIG. 5 | 1.6 W/g(2500 rpm) | 5 min | A |
| 28 | 1 | titania fine particle 1 | 1.63 | — | 4.80 | — | 400 | FIG. 5 | 1.6 W/g(2500 rpm) | 5 min | A |
| 29 | 1 | alumina fine particle 7 | 1.50 | 0.40 | — | 90 | — | FIG. 5 | 1.6 W/g(2500 rpm) | 5 min | A |
| 30 | 1 | alumina fine particle 8 | 1.63 | 0.40 | — | 810 | — | FIG. 5 | 1.6 W/g(2500 rpm) | 5 min | A |

TABLE 1-continued

| | Magnetic toner particle No. | alumina/titania fine particle | External additive (mass parts) silica | alumina | titania | Number-average particle diameter of the primary particles of the external additive (nm) alumina | titania | External addition apparatus | External addition conditions Mixing conditions | Mixing time | External addition conditions for the alumina fine particles and/or titania fine particles |
|---|---|---|---|---|---|---|---|---|---|---|---|
| 31 | 1 | alumina fine particle 1 | 1.50 | 0.01 | — | 400 | — | FIG. 5 | 0.6 W/g(1400 rpm) | 5 min | A |
| 32 | 1 | alumina fine particle 1 | 1.63 | 4.80 | — | 400 | — | FIG. 5 | 0.6 W/g(1400 rpm) | 5 min | A |
| 33 | 1 | titania fine particle 1 | 1.50 | — | 0.01 | — | 400 | FIG. 5 | 0.6 W/g(1400 rpm) | 5 min | A |
| 34 | 1 | titania fine particle 1 | 1.63 | — | 4.80 | — | 400 | FIG. 5 | 0.6 W/g(1400 rpm) | 5 min | A |
| 35 | 1 | alumina fine particle 7 | 1.50 | 0.40 | — | 90 | — | FIG. 5 | 0.6 W/g(1400 rpm) | 5 min | A |
| 36 | 1 | alumina fine particle 8 | 1.63 | 0.40 | — | 810 | — | FIG. 5 | 0.6 W/g(1400 rpm) | 5 min | A |
| 37 | 1 | alumina fine particle 1 | 2.60 | 0.01 | — | 400 | — | FIG. 5 | 1.6 W/g(2500 rpm) | 5 min | A |
| 38 | 1 | alumina fine particle 1 | 2.83 | 4.80 | — | 400 | — | FIG. 5 | 1.6 W/g(2500 rpm) | 5 min | A |
| 39 | 1 | titania fine particle 1 | 2.60 | — | 0.01 | — | 400 | FIG. 5 | 1.6 W/g(2500 rpm) | 5 min | A |
| 40 | 1 | titania fine particle 1 | 2.83 | — | 4.80 | — | 400 | FIG. 5 | 1.6 W/g(2500 rpm) | 5 min | A |
| 41 | 1 | alumina fine particle 7 | 2.60 | 0.40 | — | 90 | — | FIG. 5 | 1.6 W/g(2500 rpm) | 5 min | A |
| 42 | 1 | alumina fine particle 8 | 2.83 | 0.40 | — | 810 | — | FIG. 5 | 1.6 W/g(2500 rpm) | 5 min | A |
| 43 | 1 | alumina fine particle 1 | 2.60 | 0.01 | — | 400 | — | FIG. 5 | 0.6 W/g(1400 rpm) | 5 min | A |
| 44 | 1 | alumina fine particle 1 | 2.83 | 4.80 | — | 400 | — | FIG. 5 | 0.6 W/g(1400 rpm) | 5 min | A |
| 45 | 1 | titania fine particle 1 | 2.60 | — | 0.01 | — | 400 | FIG. 5 | 0.6 W/g(1400 rpm) | 5 min | A |
| 46 | 1 | titania fine particle 1 | 2.83 | — | 4.80 | — | 400 | FIG. 5 | 0.6 W/g(1400 rpm) | 5 min | A |
| 47 | 1 | alumina fine particle 7 | 2.60 | 0.40 | — | 90 | — | FIG. 5 | 0.6 W/g(1400 rpm) | 5 min | A |
| 48 | 1 | alumina fine particle 8 | 2.83 | 0.40 | — | 810 | — | FIG. 5 | 0.6 W/g(1400 rpm) | 5 min | A |
| 49 | 1 | alumina fine particle 9 | 1.70 | 0.20 | — | 570 | — | Henschel mixer | [1]2500 rpm [2]2500 rpm | [1]4 min [2]4 min | C |
| 50 | 1 | alumina fine particle 6 | 1.10 | 0.20 | — | 210 | — | Spherical mixing tank | [1]50 m/s [2]50 m/s [3]50 m/s | [1]2 min [2]2 min [3]2 min | D |

A: External addition by addition at the same time as the silica fine particles

B: The silica fine particles are externally added after the external addition of the alumina fine particles C: External addition in two stages (1) 0.20 mass parts alumina fine particle and 1.70 mass parts silica fine particle (2) 1.00 mass part strontium titanate D: External addition in three stages (1) 1.00 mass part silica fine particle (2) 0.20 mass parts alumina fine particle (3) 0.10 mass parts zinc stearate and 0.10 mass parts silica fine particle

TABLE 2

| | Coverage ratio A (%) | B/A | [E] | [F] | Coefficient of variation on coverage ratio A (%) | (X − Y)/X |
|---|---|---|---|---|---|---|
| Magnetic toner No. | | | | | | |
| 1 | 55.1 | 0.69 | 15.0 | 400 | 6.5 | 0.91 |
| 2 | 58.3 | 0.73 | 15.1 | 400 | 6.3 | 0.92 |
| 3 | 50.2 | 0.63 | 14.9 | 400 | 9.4 | 0.90 |
| 4 | 55.1 | 0.69 | 15.0 | 400 | 6.5 | 0.91 |
| 5 | 58.2 | 0.72 | 14.9 | 400 | 6.5 | 0.92 |
| 6 | 50.0 | 0.62 | 14.8 | 400 | 9.5 | 0.90 |
| 7 | 50.2 | 0.69 | 14.9 | 400 | 6.6 | 0.90 |
| 8 | 46.8 | 0.63 | 14.9 | 400 | 9.8 | 0.90 |
| 9 | 45.5 | 0.72 | 15.1 | 400 | 6.7 | 0.92 |
| 10 | 68.4 | 0.67 | 15.0 | 400 | 6.4 | 0.91 |
| 11 | 45.2 | 0.84 | 1.0 | 100 | 6.6 | 0.91 |
| 12 | 46.0 | 0.83 | 1.1 | 800 | 6.6 | 0.95 |
| 13 | 45.2 | 0.84 | 149.0 | 100 | 6.6 | 0.91 |
| 14 | 45.2 | 0.84 | 149.4 | 600 | 6.6 | 0.94 |
| 15 | 45.9 | 0.52 | 1.1 | 100 | 7.1 | 0.90 |
| 16 | 46.0 | 0.53 | 1.2 | 800 | 6.1 | 0.98 |
| 17 | 45.9 | 0.52 | 148.0 | 100 | 7.1 | 0.90 |
| 18 | 46.0 | 0.53 | 149.8 | 600 | 6.1 | 0.97 |
| 19 | 69.1 | 0.84 | 1.0 | 100 | 6.7 | 0.92 |
| 20 | 69.1 | 0.84 | 1.2 | 800 | 6.6 | 0.94 |
| 21 | 69.1 | 0.84 | 149.0 | 100 | 6.7 | 0.90 |
| 22 | 69.1 | 0.84 | 149.7 | 600 | 6.6 | 0.95 |
| 23 | 69.0 | 0.52 | 1.1 | 100 | 6.6 | 0.91 |
| 24 | 69.0 | 0.52 | 1.3 | 800 | 6.6 | 0.98 |

TABLE 2-continued

| | Coverage ratio A (%) | B/A | [E] | [F] | Coefficient of variation on coverage ratio A (%) | (X − Y)/X |
|---|---|---|---|---|---|---|
| 25 | 69.0 | 0.52 | 147.0 | 100 | 6.6 | 0.90 |
| 26 | 69.0 | 0.52 | 149.9 | 600 | 6.6 | 0.97 |
| 27 | 45.2 | 0.84 | 15.5 | 400 | 6.6 | 0.75 |
| 28 | 45.9 | 0.52 | 15.2 | 400 | 7.1 | 0.79 |
| 29 | 69.1 | 0.84 | 15.4 | 400 | 6.7 | 0.76 |
| 30 | 69.0 | 0.52 | 15.2 | 400 | 6.6 | 0.77 |
| 31 | 55.1 | 0.69 | 15.4 | 400 | 6.6 | 0.73 |
| 32 | 55.5 | 0.69 | 15.7 | 400 | 12.4 | 0.70 |
| 33 | 55.0 | 0.70 | 15.9 | 400 | 11.2 | 0.71 |
| 34 | 54.8 | 0.69 | 115.2 | 700 | 6.5 | 0.90 |
| 35 | 54.6 | 0.68 | 125.4 | 700 | 6.6 | 0.91 |
| 36 | 55.0 | 0.69 | 15.0 | 400 | 6.5 | 0.91 |
| Comparative magnetic toner No. | | | | | | |
| 1 | 36.0 | 0.41 | 14.9 | 400 | 17.8 | 0.93 |
| 2 | 38.1 | 0.42 | 14.8 | 400 | 18.1 | 0.92 |
| 3 | 50.1 | 0.35 | 14.9 | 400 | 13.1 | 0.93 |
| 4 | 52.3 | 0.36 | 14.9 | 400 | 12.0 | 0.91 |
| 5 | 72.0 | 0.45 | 15.0 | 400 | 14.0 | 0.92 |
| 6 | 43.4 | 0.83 | 14.9 | 400 | 13.3 | 0.84 |
| 7 | 44.6 | 0.85 | 14.9 | 400 | 12.6 | 0.87 |
| 8 | 42.5 | 0.47 | 14.9 | 400 | 15.1 | 0.90 |
| 9 | 55.2 | 0.48 | 14.9 | 400 | 14.7 | 0.92 |
| 10 | 63.0 | 0.88 | 14.8 | 400 | 13.1 | 0.91 |

TABLE 2-continued

| | Coverage ratio A (%) | B/A | [E] | [F] | Coefficient of variation on coverage ratio A (%) | (X − Y)/X |
|---|---|---|---|---|---|---|
| 11 | 71.4 | 0.82 | 14.9 | 400 | 12.9 | 0.90 |
| 12 | 72.0 | 0.88 | 15.1 | 400 | 12.9 | 0.89 |
| 13 | 46.1 | 0.47 | 14.9 | 400 | 12.3 | 0.91 |
| 14 | 43.0 | 0.53 | 14.8 | 400 | 13.4 | 0.92 |
| 15 | 72.2 | 0.53 | 14.9 | 400 | 12.1 | 0.90 |
| 16 | 68.1 | 0.47 | 14.9 | 400 | 11.9 | 0.91 |
| 17 | 46.9 | 0.88 | 14.9 | 400 | 12.5 | 0.90 |
| 18 | 35.8 | 0.48 | 15.0 | 400 | 10.2 | 0.92 |
| 19 | 55.1 | 0.70 | 0.2 | 400 | 6.6 | 0.90 |
| 20 | 55.5 | 0.69 | 158.2 | 400 | 6.5 | 0.91 |
| 21 | 55.1 | 0.70 | 0.2 | 400 | 6.6 | 0.91 |
| 22 | 55.5 | 0.69 | 159.0 | 400 | 6.5 | 0.92 |
| 23 | 55.1 | 0.70 | — | 90 | 6.6 | 0.91 |
| 24 | 55.5 | 0.69 | — | 810 | 6.5 | 0.91 |
| 25 | 45.9 | 0.84 | 0.2 | 400 | 6.5 | 0.90 |
| 26 | 46.2 | 0.83 | 158.5 | 400 | 6.5 | 0.90 |
| 27 | 45.9 | 0.84 | 0.2 | 400 | 6.5 | 0.90 |
| 28 | 46.2 | 0.83 | 159.3 | 400 | 6.5 | 0.90 |
| 29 | 45.9 | 0.84 | — | 90 | 6.5 | 0.90 |
| 30 | 46.2 | 0.83 | — | 810 | 6.5 | 0.90 |
| 31 | 45.5 | 0.52 | 0.2 | 400 | 6.5 | 0.94 |
| 32 | 46.0 | 0.52 | 158.0 | 400 | 6.5 | 0.95 |
| 33 | 45.5 | 0.52 | 0.2 | 400 | 6.5 | 0.93 |
| 34 | 46.0 | 0.52 | 158.8 | 400 | 6.5 | 0.94 |
| 35 | 45.5 | 0.52 | — | 90 | 6.5 | 0.94 |
| 36 | 46.0 | 0.52 | — | 810 | 6.5 | 0.93 |
| 37 | 69.1 | 0.82 | 0.2 | 400 | 6.1 | 0.91 |
| 38 | 68.5 | 0.84 | 158.4 | 400 | 6.1 | 0.90 |
| 39 | 69.1 | 0.82 | 0.2 | 400 | 6.1 | 0.90 |
| 40 | 68.5 | 0.84 | 159.2 | 400 | 6.1 | 0.90 |
| 41 | 69.1 | 0.82 | — | 90 | 6.1 | 0.90 |
| 42 | 68.5 | 0.84 | — | 810 | 6.1 | 0.90 |
| 43 | 69.3 | 0.52 | 0.2 | 400 | 6.4 | 0.94 |
| 44 | 69.0 | 0.51 | 157.9 | 400 | 6.4 | 0.93 |
| 45 | 69.3 | 0.52 | 0.2 | 400 | 6.4 | 0.92 |
| 46 | 69.0 | 0.51 | 158.7 | 400 | 6.4 | 0.94 |
| 47 | 69.3 | 0.52 | — | 90 | 6.4 | 0.93 |
| 48 | 69.0 | 0.51 | — | 810 | 6.4 | 0.93 |
| 49 | 50.0 | 0.35 | 2.3 | 570 | 13.1 | 0.90 |
| 50 | 41.0 | 0.40 | 48.6 | 210 | 15.4 | 0.82 |

[E]: Number of alumina fine particles and/or titania fine particles each of which has a particle diameter of from at least 100 nm to not more than 800 nm present on the surface of the magnetic toner particles per magnetic toner particle
[F]: Number-average particle diameter of the primary particles of the alumina fine particles/titania fine particles (nm)

Example 1

The Image-Forming Apparatus

The image-forming apparatus was an LBP-3100 (Canon, Inc.), which was equipped with a small-diameter toner-carrying member that had a diameter of 10 mm; its printing speed had been modified from 16 sheets/minute to 20 sheets/minute. In an image-forming apparatus equipped with a small-diameter toner-carrying member, the durability and ghosting can be rigorously evaluated by changing the printing speed to 20 sheets/minute to provide an environment in which differences between the amount of charge on the residual toner and supplied toner are prominently displayed.

Using this modified apparatus and magnetic toner 1, durability tests were carried out in a normal-temperature, normal-humidity environment (23.0° C./50% RH) and in a low-temperature, low-humidity environment (15.0° C./10% RH) by making 1500 prints in one-sheet intermittent mode of a horizontal line image having a print percentage of 2%. This was followed by standing in the same environment for 3 days and then evaluation of the image density, fogging, and ghosting was carried out. Since there is less moisture in the air in the low-temperature, low-humidity environment than in the normal-temperature, normal-humidity environment, suppression of magnetic toner charging does not occur and a more rigorous evaluation can be performed because a state is assumed in which magnetic toner charging readily ramps up. In addition, an even more rigorous evaluation can be performed since the flowability readily declines when standing for 3 days is performed after the output of 1500 prints.

According to the results, even in the low-temperature, low-humidity environment, a ghost-free, high-image density image could be obtained that also presented little fogging in the nonimage areas. The results of the evaluations in the normal-temperature, normal-humidity environment and in the low-temperature, low-humidity environment are given in Table 3.

The evaluation methods and associated scales used in the evaluations referenced above are described below.

<Image Density>

For the image density, a solid image was formed and the density of this solid image was measured with a MacBeth reflection densitometer (MacBeth Corporation).

<Fogging>

A white image was output and its reflectance was measured using a REFLECTMETER MODEL TC-6DS from Tokyo Denshoku Co., Ltd. On the other hand, the reflectance was also similarly measured on the transfer paper (standard paper) prior to formation of the white image. A green filter was used as the filter. The fogging was calculated using the following formula from the reflectance before output of the white image and the reflectance after output of the white image.

fogging (reflectance)(%)=reflectance(%) of the standard paper−reflectance(%) of the white image sample The scale for evaluating the fogging is below.

very good (less than 1.5%)

good (less than 2.5% and greater than or equal to 1.5%)

average (less than 4.0% and greater than or equal to 2.5%)

poor (greater than or equal to 4.0%)

<Ghosting>

A plurality of 10 mm×10 mm solid images were produced in the top half of the image and a 2 dot×3 space halftone image was produced in the bottom half of the image, and the degree to which traces of the solid image were produced in the halftone image was determined by visual inspection. The image density was measured using a MacBeth reflection densitometer (MacBeth Corporation).

A: very good (No ghosting is produced.)

B: good (Ghosting is produced, but is almost visually imperceptible. The density difference between the solid image area and the halftone image area is less than 0.05.)

C: image unproblematic from a practical standpoint (The boundary between the solid image area and the halftone image area is ambiguous. The density difference between the two is greater than or equal to 0.05 and less than 0.20.)

D: the level of ghosting is poor; image undesirable from a practical standpoint (The boundary between the solid image area and the halftone image area is well defined and the density difference between the two is at least 0.20.)

Examples 2 to 36

Image output testing was performed as in Example 1, but using magnetic toners 2 to 36. According to the results, all of the magnetic toners provided images that were at least at practically unproblematic levels. The results of the evaluations in the normal-temperature, normal-humidity environment and in the low-temperature, low-humidity environment are shown in Table 3.

Comparative Examples 1 to 50

Image output testing was performed as in Example 1, but using comparative magnetic toners 1 to 50. According to the results, ghosting was very poor in the low-temperature, low-humidity environment for all of the magnetic toners. The results of the evaluations in the normal-temperature, normal-humidity environment and in the low-temperature, low-humidity environment are shown in Table 3.

TABLE 3

| | normal-temperature, normal-humidity environment (after 1500 print durability test + after standing for 3 days) | | | low-temperature, low-humidity environment (after 1500 print durability test + after standing for 3 days) | | |
|---|---|---|---|---|---|---|
| | image density | fogging | ghosting | image density | fogging | ghosting |
| Magnetic toner No. | | | | | | |
| 1 | 1.54 | 0.4 | A | 1.52 | 0.6 | A |
| 2 | 1.52 | 0.3 | A | 1.51 | 0.5 | A |
| 3 | 1.48 | 0.5 | A | 1.47 | 0.5 | A |
| 4 | 1.55 | 0.3 | A | 1.54 | 0.5 | A |
| 5 | 1.51 | 0.3 | A | 1.50 | 0.6 | A |
| 6 | 1.47 | 0.5 | A | 1.46 | 0.5 | A |
| 7 | 1.50 | 0.5 | A | 1.48 | 0.8 | A |
| 8 | 1.47 | 0.6 | A | 1.46 | 0.7 | A |
| 9 | 1.53 | 0.4 | A | 1.51 | 0.6 | A |
| 10 | 1.53 | 0.4 | A | 1.52 | 0.6 | A |
| 11 | 1.49 | 0.5 | A | 1.47 | 0.7 | A |
| 12 | 1.48 | 0.5 | A | 1.46 | 0.7 | A |
| 13 | 1.50 | 0.5 | A | 1.48 | 0.7 | A |
| 14 | 1.49 | 0.6 | A | 1.47 | 0.8 | A |
| 15 | 1.49 | 0.5 | A | 1.47 | 0.7 | A |
| 16 | 1.48 | 0.5 | A | 1.46 | 0.7 | A |
| 17 | 1.50 | 0.5 | A | 1.49 | 0.7 | A |
| 18 | 1.49 | 0.6 | A | 1.47 | 0.8 | A |
| 19 | 1.49 | 0.5 | A | 1.47 | 0.7 | A |
| 20 | 1.48 | 0.5 | A | 1.46 | 0.7 | A |
| 21 | 1.50 | 0.5 | A | 1.48 | 0.7 | A |
| 22 | 1.49 | 0.6 | A | 1.47 | 0.8 | A |
| 23 | 1.49 | 0.5 | A | 1.47 | 0.7 | A |
| 24 | 1.48 | 0.5 | A | 1.46 | 0.7 | A |
| 25 | 1.50 | 0.5 | A | 1.49 | 0.7 | A |
| 26 | 1.49 | 0.6 | A | 1.47 | 0.8 | A |
| 27 | 1.46 | 0.8 | A | 1.44 | 1.1 | A |
| 28 | 1.47 | 0.7 | A | 1.45 | 1.1 | A |
| 29 | 1.46 | 0.8 | A | 1.44 | 1.0 | A |
| 30 | 1.46 | 0.7 | A | 1.44 | 0.9 | A |
| 31 | 1.44 | 1.1 | A | 1.42 | 1.3 | A |
| 32 | 1.38 | 1.5 | B | 1.35 | 1.9 | C |
| 33 | 1.39 | 1.6 | B | 1.36 | 2.0 | C |
| 34 | 1.36 | 1.7 | B | 1.33 | 2.1 | C |
| 35 | 1.34 | 1.8 | B | 1.32 | 2.3 | C |
| 36 | 1.54 | 0.5 | A | 1.53 | 0.7 | A |
| Comparative magnetic toner No. | | | | | | |
| 1 | 1.30 | 2.5 | C | 1.27 | 2.7 | D |
| 2 | 1.31 | 2.4 | C | 1.29 | 2.6 | D |
| 3 | 1.28 | 2.9 | C | 1.24 | 3.1 | D |
| 4 | 1.30 | 2.6 | C | 1.27 | 2.8 | D |
| 5 | 1.30 | 2.8 | C | 1.28 | 3.0 | D |
| 6 | 1.30 | 2.6 | C | 1.27 | 2.8 | D |
| 7 | 1.3 | 2.8 | C | 1.28 | 3.0 | D |
| 8 | 1.28 | 2.9 | C | 1.26 | 3.1 | D |

TABLE 3-continued

| | normal-temperature, normal-humidity environment (after 1500 print durability test + after standing for 3 days) | | | low-temperature, low-humidity environment (after 1500 print durability test + after standing for 3 days) | | |
|---|---|---|---|---|---|---|
| | image density | fogging | ghosting | image density | fogging | ghosting |
| 9 | 1.38 | 2.3 | C | 1.36 | 2.5 | D |
| 10 | 1.36 | 2.2 | C | 1.34 | 2.4 | D |
| 11 | 1.38 | 2.2 | C | 1.36 | 2.4 | D |
| 12 | 1.38 | 2.4 | C | 1.36 | 2.6 | D |
| 13 | 1.38 | 1.7 | C | 1.36 | 1.9 | D |
| 14 | 1.39 | 1.6 | C | 1.37 | 1.8 | D |
| 15 | 1.38 | 1.7 | C | 1.36 | 1.9 | D |
| 16 | 1.37 | 1.7 | C | 1.35 | 1.9 | D |
| 17 | 1.37 | 1.7 | C | 1.35 | 1.9 | D |
| 18 | 1.33 | 2.4 | C | 1.32 | 2.7 | D |
| 19 | 1.49 | 0.5 | C | 1.49 | 0.5 | D |
| 20 | 1.50 | 0.4 | C | 1.50 | 0.4 | D |
| 21 | 1.50 | 0.5 | C | 1.50 | 0.5 | D |
| 22 | 1.51 | 0.4 | C | 1.51 | 0.4 | D |
| 23 | 1.50 | 0.5 | C | 1.50 | 0.5 | D |
| 24 | 1.47 | 0.5 | C | 1.47 | 0.5 | D |
| 25 | 1.46 | 0.7 | C | 1.33 | 0.9 | D |
| 26 | 1.48 | 0.8 | C | 1.34 | 1.0 | D |
| 27 | 1.47 | 0.7 | C | 1.33 | 0.9 | D |
| 28 | 1.48 | 0.8 | C | 1.34 | 1.0 | D |
| 29 | 1.47 | 0.7 | C | 1.33 | 0.9 | D |
| 30 | 1.48 | 0.8 | C | 1.34 | 1.0 | D |
| 31 | 1.48 | 0.8 | C | 1.34 | 1.0 | D |
| 32 | 1.49 | 0.6 | C | 1.35 | 0.8 | D |
| 33 | 1.48 | 0.8 | C | 1.34 | 1.0 | D |
| 34 | 1.49 | 0.6 | C | 1.35 | 0.8 | D |
| 35 | 1.48 | 0.8 | C | 1.34 | 1.0 | D |
| 36 | 1.49 | 0.6 | C | 1.35 | 0.8 | D |
| 37 | 1.46 | 0.6 | C | 1.32 | 0.8 | D |
| 38 | 1.47 | 0.7 | C | 1.33 | 0.9 | D |
| 39 | 1.46 | 0.6 | C | 1.32 | 0.8 | D |
| 40 | 1.47 | 0.7 | C | 1.33 | 0.9 | D |
| 41 | 1.46 | 0.6 | C | 1.32 | 0.8 | D |
| 42 | 1.47 | 0.7 | C | 1.33 | 0.9 | D |
| 43 | 1.48 | 0.8 | C | 1.34 | 1.0 | D |
| 44 | 1.49 | 0.6 | C | 1.35 | 0.8 | D |
| 45 | 1.48 | 0.8 | C | 1.34 | 1.0 | D |
| 46 | 1.49 | 0.6 | C | 1.35 | 0.8 | D |
| 47 | 1.48 | 0.8 | C | 1.34 | 1.0 | D |
| 48 | 1.49 | 0.6 | C | 1.35 | 0.8 | D |
| 49 | 1.44 | 1.2 | C | 1.42 | 1.4 | D |
| 50 | 1.45 | 1.1 | C | 1.43 | 1.3 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-019521, filed on Feb. 1, 2012, which is hereby incorporated by reference herein in its entirety.

REFERENCE SIGNS LIST

1: main casing
2: rotating member
3, 3*a*, 3*b*: stirring member
4: jacket
5: raw material inlet port
6: product discharge port
7: center shaft
8: drive member
9: processing space
10: end surface of the rotating member
11: direction of rotation

12: back direction
13: forward direction
16: raw material inlet port inner piece
17: product discharge port inner piece
d: distance showing the overlapping portion of the stirring members
D: stirring member width
100: electrostatic latent image-bearing member (photosensitive member)
102: toner-carrying member
103: regulating blade
114: transfer member (transfer roller)
116: cleaner
117: charging member (charging roller)
121: laser generator (latent image-forming means, photoexposure apparatus)
123: laser
124: register roller
125: transport belt
126: fixing unit
140: developing device
141: stirring member

The invention claimed is:

1. A magnetic toner comprising:

magnetic toner particles comprising a binder resin and a magnetic body; and inorganic fine particles present on the surface of the magnetic toner particles, wherein;

the inorganic fine particles present on the surface of the magnetic toner particles comprise silica fine particles and at least one of alumina fine particles and titania fine particles, wherein;

when a coverage ratio A (%) is a coverage ratio of the magnetic toner particles' surface by the inorganic fine particles each of which has a particle diameter of from at least 5 nm to not more than 50 nm and a coverage ratio B (%) is a coverage ratio of the magnetic toner particles' surface by the inorganic fine particles each of which has a particle diameter of from at least 5 nm to not more than 50 nm and is fixed to the magnetic toner particles' surface, the magnetic toner has a coverage ratio A of at least 45.0% and not more than 70.0% and a ratio [coverage ratio B/coverage ratio A] of the coverage ratio B to the coverage ratio A of at least 0.50 and not more than 0.85, and wherein at least one of the alumina fine particles and the titania fine particles each of which has a particle diameter of from at least 100 nm to not more than 800 nm is present on the surface of magnetic toner particles at from at least 1 particle to not more than 150 particles, as the total number of the alumina fine particles and the titania fine particles, per magnetic toner particle.

2. The magnetic toner according to claim 1, wherein the coefficient of variation on the coverage ratio A is not more than 10.0%.

3. The magnetic toner according to claim 1, wherein the amount of the at least one of the alumina fine particles and the titania fine particles each of which has a particle diameter of from at least 100 nm to not more than 800 nm and is present on the surface of the magnetic toner particles satisfies the following formula (1):

$$(X-Y)/X \geq 0.75 \quad (1)$$

wherein, X is the total number of the at least one of the alumina fine particles and the titania fine particles each of which has a particle diameter of from at least 100 nm to not more than 800 nm and is present on the surface of the magnetic toner particles per magnetic toner particle, and Y is the total number of the at least one of the alumina fine particles and the titania fine particles each of which has a particle diameter of from at least 100 nm to not more than 800 nm and is fixed to the magnetic toner particles' surface per magnetic toner particle.

* * * * *